US012509986B2

(12) United States Patent
Drenth et al.

(10) Patent No.: US 12,509,986 B2
(45) Date of Patent: Dec. 30, 2025

(54) DEVICES, SYSTEMS, AND METHODS FOR WIRELESS DATA ACQUISITION DURING DRILLING OPERATIONS

(71) Applicants: Veracio Ltd., Salt Lake City, UT (US); GLOBALTECH CORPORATION PTY LTD, Forrestfield (AU)

(72) Inventors: Christopher L. Drenth, Callander (CA); Gordon Stewart, Perth (AU); Brett Wilkinson, Perth (AU); Raymond Hill, Perth (AU)

(73) Assignees: VERACIO LTD., Salt Lake City, UT (US); GLOBAL TECH CORPORATION PTY LTD, Forrestfield (AU)

( * ) Notice: Subject to any disclaimer, the term of this patent is extended or adjusted under 35 U.S.C. 154(b) by 0 days.

(21) Appl. No.: 18/652,181

(22) Filed: May 1, 2024

(65) Prior Publication Data

US 2024/0352851 A1 Oct. 24, 2024

Related U.S. Application Data

(63) Continuation of application No. 17/966,365, filed on Oct. 14, 2022, now Pat. No. 11,976,551, which is a continuation of application No. 17/018,133, filed on Sep. 11, 2020, now Pat. No. 11,499,410.

(60) Provisional application No. 62/899,555, filed on Sep. 12, 2019.

(51) Int. Cl.

| | |
|---|---|
| ***E21B 47/13*** | (2012.01) |
| ***E21B 25/00*** | (2006.01) |
| ***E21B 44/00*** | (2006.01) |
| ***E21B 47/06*** | (2012.01) |

(52) U.S. Cl.

CPC ..... *E21B 47/13* (2020.05); *E21B 25/00* (2013.01); *E21B 44/00* (2013.01); *E21B 47/06* (2013.01)

(58) Field of Classification Search

CPC ..... E21B 44/00; E21B 25/00; E21B 47/06; E21B 47/13; E21B 47/007; E21B 47/01; H04L 67/125; H04W 4/38

See application file for complete search history.

(56) References Cited

U.S. PATENT DOCUMENTS

| | | | | |
|---|---|---|---|---|
| 2015/0300162 | A1* | 10/2015 | Drenth | E21B 25/16 175/44 |
| 2017/0030181 | A1* | 2/2017 | Thomas | E21B 44/04 |
| 2017/0241253 | A1* | 8/2017 | Chapman | E21B 47/12 |
| 2019/0128114 | A1* | 5/2019 | Bryant | E21B 47/107 |
| 2019/0154859 | A1* | 5/2019 | Song | E21B 47/13 |
| 2019/0257161 | A1* | 8/2019 | Dewald | E21B 19/07 |

* cited by examiner

*Primary Examiner* — Brad Harcourt

(74) *Attorney, Agent, or Firm* — Stites & Harbison, PLLC; Terry L. Wright

(57) ABSTRACT

A drilling system can comprise a drill string having a longitudinal axis and comprising at least one drill rod and a wireless sub coupled to the at least one drill rod. The wireless sub can comprise processing circuitry that is configured to detect mechanical impulses of the drill string. The processing circuitry can be configured to wirelessly transmit signals indicative of the mechanical impulses to a remote computing device.

21 Claims, 24 Drawing Sheets

DEVICES, SYSTEMS, AND METHODS FOR WIRELESS DATA ACQUISITION DURING DRILLING OPERATIONS

CROSS-REFERENCE TO RELATED APPLICATION

This application is a continuation of U.S. patent application Ser. No. 17/966,365, filed Oct. 14, 2022, which is a continuation of U.S. patent application Ser. No. 17/018,133, filed Sep. 11, 2020, which claims priority to and the benefit of the filing date of U.S. Provisional Patent Application No. 62/899,555, filed Sep. 12, 2019. The entirety of each of these applications is hereby incorporated by reference herein.

FIELD

The disclosed invention relates to drilling systems and methods for wirelessly acquiring and transmitting data during drilling operations.

BACKGROUND

During drilling operations, information describing in-hole conditions can be used by drilling operators to optimize or otherwise control the drilling operations. However, in use, conventional drilling systems do not provide an adequate mechanism for clearly and reliably transmitting such information to drilling operators, and the minimal acquired information is often insufficient. For example, current drilling systems may not be able to detect conditions indicating imminent permanent drill string deformation.

Thus, there is a need for systems and methods that increase the amount and type of information that can be obtained during drilling. There is a further need for systems and methods that can reliably and efficiently transmit such information to a drilling operator positioned outside the borehole.

SUMMARY

Described herein, in various aspects, is a drilling system, comprising a drill string having a longitudinal axis, at least one drill rod, and a wireless sub coupled to the at least one drill rod. The wireless sub can comprise processing circuitry that is configured to detect mechanical impulses of the drill string. The processing circuitry can be configured to wirelessly transmit signals indicative of the mechanical impulses to a remote computing device. Drill rods can be added and removed distally of the wireless sub so that the wireless sub can remain outside of a borehole during use (optionally, during formation of an entire borehole).

In other aspects, described herein is a drilling system including a drill string and an inner tube assembly. The drill string can have a longitudinal axis and at least one adapter. Each adapter of the at least one adapter can comprise processing circuitry. The inner tube assembly can be configured for positioning within the drill string. The inner tube assembly can have a core barrel and processing circuitry. The core barrel head assembly can define an interior cavity, and the processing circuitry of the inner tube assembly can be positioned within the interior cavity of the core barrel head assembly. The processing circuitry of the inner tube assembly can be configured to detect mechanical impulses during drilling operations within a borehole and to wirelessly transmit signals indicative of the mechanical impulses to the processing circuitry of the at least one adapter of the drill string. The processing circuitry of the at least one adapter of the drill string can be configured to wirelessly transmit signals indicative of the mechanical impulses to a remote location outside the borehole.

In additional aspects, described herein is a drill string comprising at least one drill rod and at least one adapter operatively secured to the at least one drill rod. Each adapter of the at least one adapter can comprise processing circuitry. The at least one adapter can cooperate with the at least one drill rod to define an interior of the drill string. The processing circuitry of the at least one adapter of the drill string can be configured to detect mechanical impulses during a drilling operation within a borehole and to wirelessly transmit signals indicative of the mechanical impulses to a remote location outside the borehole.

In further aspects, described herein is a drilling method comprising conducting a drilling operation within a borehole using a drilling system as disclosed herein. The drilling method can further comprise detecting mechanical impulses using the processing circuitry of the inner tube assembly. The drilling method can further comprise using the processing circuitry of the inner tube assembly to wirelessly transmit signals indicative of the detected mechanical impulses to the processing circuitry of the drill string. The method can further comprise using the processing circuitry of the drill string to receive the signals transmitted by the processing circuitry of the inner tube assembly. The method can still further comprise using the processing circuitry of the drill string to wirelessly transmit signals indicative of the mechanical impulses to a remote location (e.g., a remote computing device) outside the borehole.

DETAILED DESCRIPTION

Figure 1A:
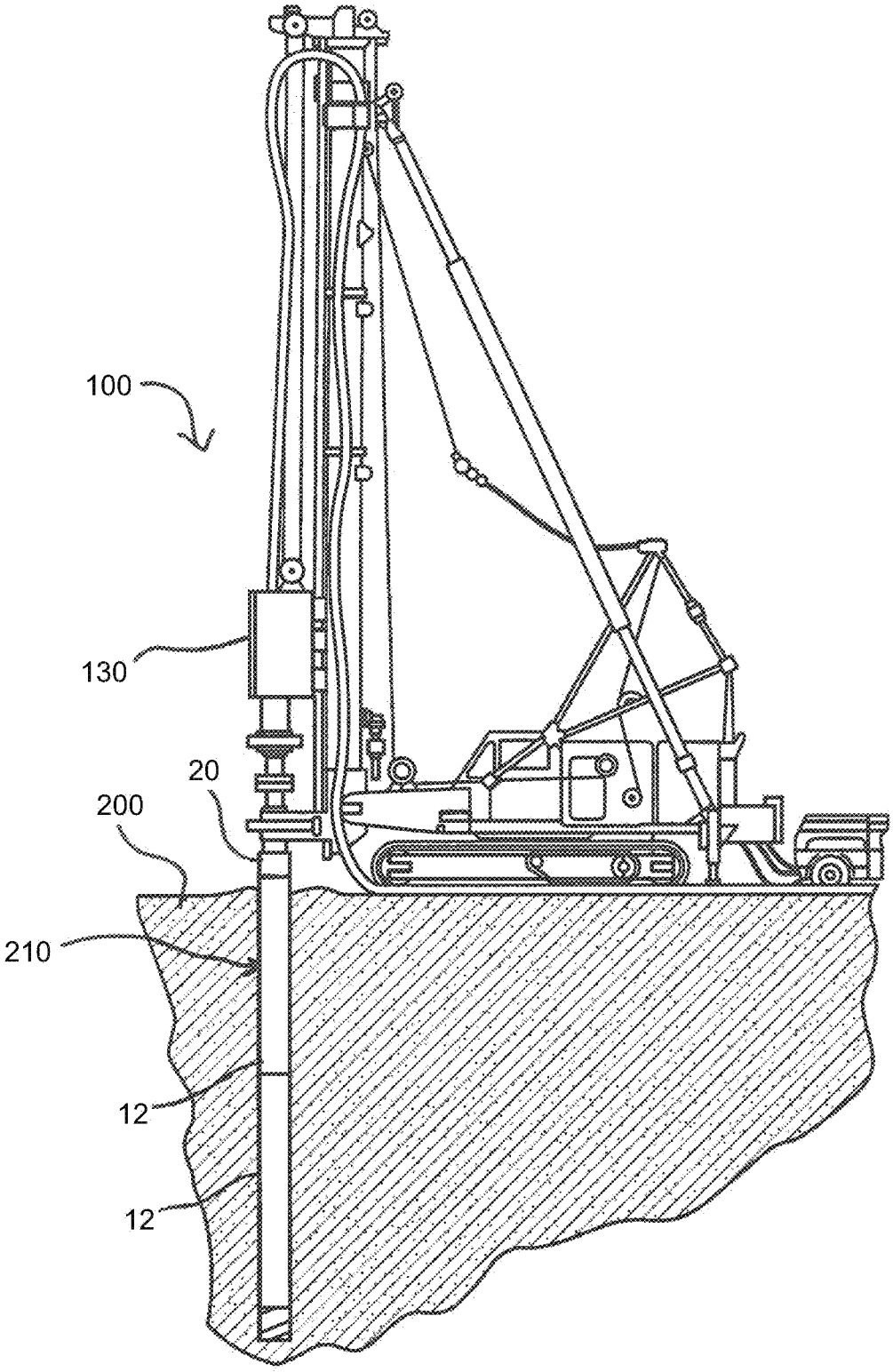
FIG. 1A is a schematic diagram depicting an exemplary drilling system having a drill string positioned within a borehole as disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a", "an", and "the" include plural referents unless the context clearly dictates otherwise. For example, use of the term "an adapter" can refer to one or more of such adapters.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, if further aspects, when values are approximated by use of "approximately," "substantially," and "generally," it is contemplated that values within up to 15%, up to 10%, up to 5%, or up to 1% (above or below) of the particularly stated value can be included within the scope of those aspects.

As used herein, the term "proximal" refers to a direction toward a drill rig or drill operator (and away from a formation or borehole), while the term "distal" refers to a direction away from the drill rig or drill operator (and into a formation or borehole).

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatuses, systems, and associated methods of using the apparatuses and systems can be implemented and used without employing these specific details. Indeed, the apparatuses, systems, and associated methods can be placed into practice by modifying the illustrated apparatus and associated methods and can be used in conjunction with any other apparatus and techniques conventionally used in the industry.

With reference to FIGS. 1A-7, disclosed herein, in various aspects, is a drilling system 100 that is configured to wirelessly acquire data during drilling operations. In these aspects, the data can relate to one or more events or conditions in a borehole 210 formed within a formation 200. In exemplary aspects, the drilling system 100 can comprise a drill string 10 and an inner tube assembly 40 configured for positioning within the drill string.

Figure 1B:
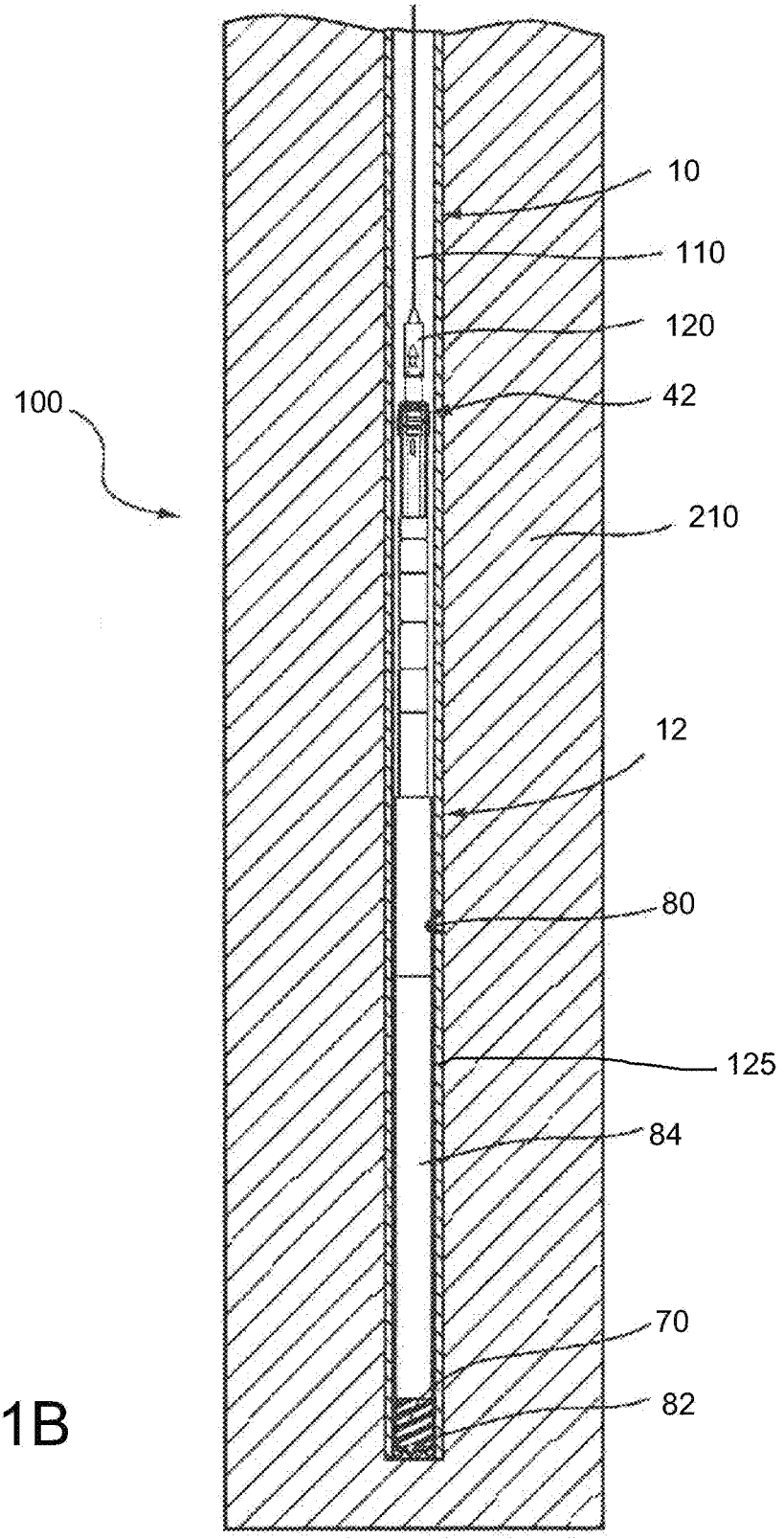
FIG. 1B is a cross-sectional view of an exemplary drilling system having a drill string, an outer tube assembly, a drill bit, and an inner tube assembly positioned within a borehole as disclosed herein.

FIGS. 1A and IC illustrate surface portions of exemplary drilling systems 100, while FIG. 1B illustrates a subterranean portion of the drilling system. The surface portion of the drilling system 100 shown in FIGS. 1A and IC includes a drill head assembly 130 that can be coupled to a mast 150 that in turn can be coupled to a drill rig in a conventional manner. The drill head assembly 130 can be configured to have a drill rod 12 coupled thereto. As illustrated in FIGS. 1A and IC, the drill rod 12 that is coupled to the drill head assembly 130 can in turn couple with additional drill rods 12 to form a drill string 10. The drill rod 10 and/or an outer tube assembly (as further disclosed herein) can be coupled to a drill bit 70 configured to interface with the material to be drilled, such as a formation 200. The drill head assembly 130 can be configured to rotate the drill string 10 and/or outer tube assembly in a conventional manner. In particular, the rotational rate of the drill string 10 and/or outer tube assembly can be varied as desired during the drilling process. Further, the drill head assembly 130 can be configured to translate relative to the mast 150 to apply an axial force to the drill string and/or outer tube assembly to urge the drill bit 70 into the formation 200 during a drilling process. The drill head assembly 130 can also generate oscillating forces that are transmitted to the drill string 10 and/or outer tube assembly. These forces can be transmitted through the drill string 10 and/or outer tube assembly to the drill bit 70.

The drilling system 100 can also include an inner tube assembly 40 positioned within the drill string 10, which in turn is positioned within a drill hole (borehole) 210. Optionally, the borehole 210 can be lined with an outer casing 125 as is known in the art, and the drill string 10 can be received within the outer casing. The inner tube assembly 40 can include a wireline 110, an overshot assembly 120, at least one inner tube 60, and a core barrel head assembly 42. In the illustrated example, the at least one inner tube 60 can be coupled to the core barrel head assembly 42, which in turn can be removably coupled to the overshot assembly 120. When thus assembled, the wireline 110 can be used to lower the inner tubes 60, the overshot assembly 120, and the core barrel head assembly 42 into position within the drill string 10. In exemplary aspects, the drilling system 100 can comprise a sled assembly 140 that can move relative to the mast 150. As the sled assembly 140 moves relative to the mast 150, the sled assembly may provide a force against the drill head assembly 130, which may push the drill bit 70, the core barrel assembly 40, the drill rods 12 and/or other portions of the drill string 10 further into the formation 200, for example, while they are being rotated.

Figure 1C:
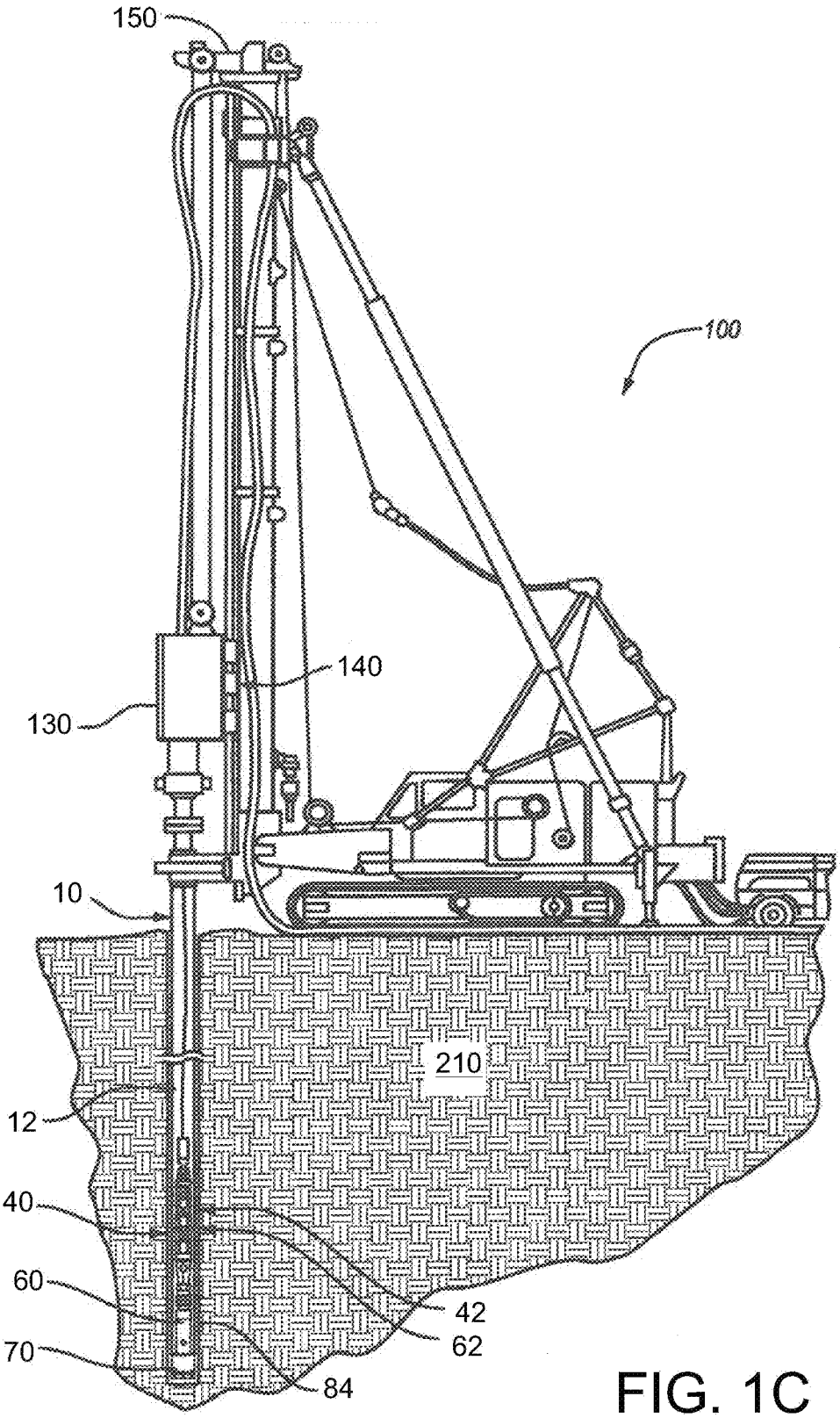
FIG. 1C is a schematic diagram depicting an exemplary drilling system having a drill string positioned within a borehole, with the drill string being shown in cross-section.
Figure 1D:
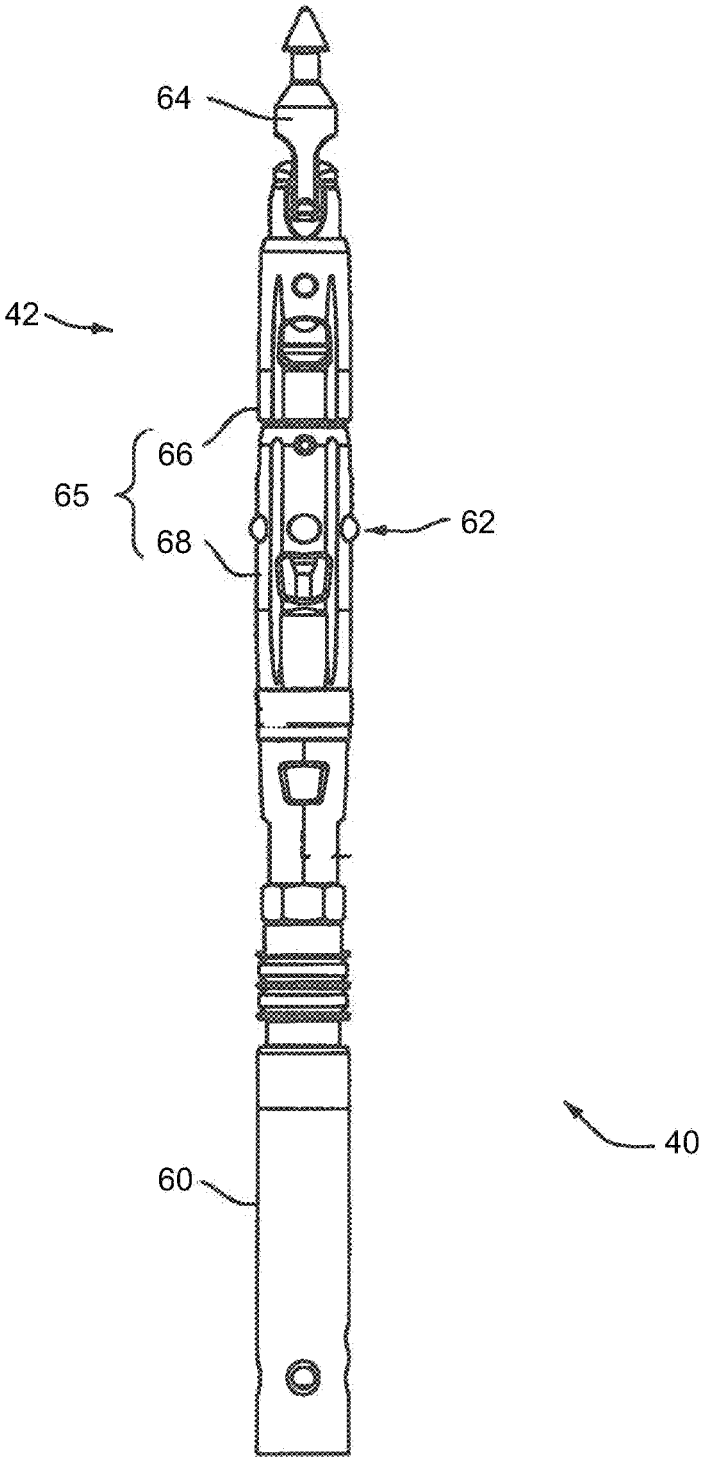
FIG. 1D is an isolated side view of an exemplary drill string as disclosed herein.

As shown in FIGS. 1C-1D, the core barrel head assembly 42 can include a latch mechanism 62 that is configured to lock the core barrel head assembly (and, consequently, the at least one inner tube 60) in position at a desired location within the drill string 10. In particular, when the inner tube assembly 40 is lowered to the desired location, the latch mechanism 62 associated with the core barrel head assembly 42 can be deployed to lock the core barrel head assembly into position relative to the drill string 10. In exemplary aspects, the latch mechanism 62 can comprise a latch body 65 having a first member 66 and a sleeve 68 as disclosed in, for example and without limitation, U.S. Pat. No. 8,869,918, entitled "Core Drilling Tools with External Fluid Pathways," which is incorporated herein by reference in its entirety. The overshot assembly 120 can also be actuated to disengage the core barrel head assembly 42. Thereafter, the at least one inner tube 60 can rotate with the drill string 10 due to the coupling of the inner tubes 60 to the core barrel head assembly 42 and of the core barrel head assembly to the drill string 10.

At some point, it may be desirable to trip the at least one inner tube 60 to the surface, such as to retrieve a core sample. To retrieve the at least one inner tube 60, the wireline 110 can be used to lower the overshot assembly 120 into engagement with the core barrel head assembly 42 (for example, via a spearhead assembly 64 as is known in the art). The core barrel head assembly 42 may then be disengaged from the drill string 10 by drawing the latches into the core barrel head assembly. Thereafter, the overshot assembly 120, the core barrel head assembly 42, and the at least one inner tube 60 can be tripped to the surface.

While a wireline type system is illustrated in FIG. 1B, it will be appreciated that the drilling system 100 can optionally be adapted for use in other applications, including, for example and without limitation, reverse circulation (RC), sonic, or percussive drilling operations. Optionally, in exemplary aspects, the drill string 10 can comprise one or more continuous coiled-tube drill rods. In these aspects, it is contemplated that the inner tube assembly 40 can remain within the drill string (i.e., not be retrievable from the drill string) and can comprise a fixed sub or adapter at its distal end.

In one aspect, the drill string 10 can have a longitudinal axis 16 and comprise at least one drill rod 12 and at least one adapter 20 coupled to the at least one drill rod. In this aspect, each adapter 20 of the at least one adapter can comprise processing circuitry 22 and cooperate with the at least one drill rod 12 to define an interior 14 of the drill string 10. For example, it is contemplated that at least one adapter 20 can comprise a hollow annular body, with the inner diameter of the adapter defining the interior 14 of the drill string 10. Optionally, it is contemplated that each adapter 20 can define an enclosed interior portion that is configured to house at least a portion of the processing circuitry 22 of the adapter. For example, it is contemplated that the processing circuitry 22 can be enclosed within the walls of the adapter. In other exemplary configurations, the processing circuitry 22 can be affixed or otherwise attached to the inner diameter of the adapter 20 (that defines the interior 14 of the drill string 10), sealed to a portion of the exterior of the adapter 20 using epoxy or other sealant materials, embedded into, housed, or at least partially received within an annular or partially annular slot or cavity defined in a wall of the adapter 20. In additional aspects, it is contemplated that an outer diameter of the adapter 20 can correspond to an outer diameter of the drill string 10.

Figure 2A:
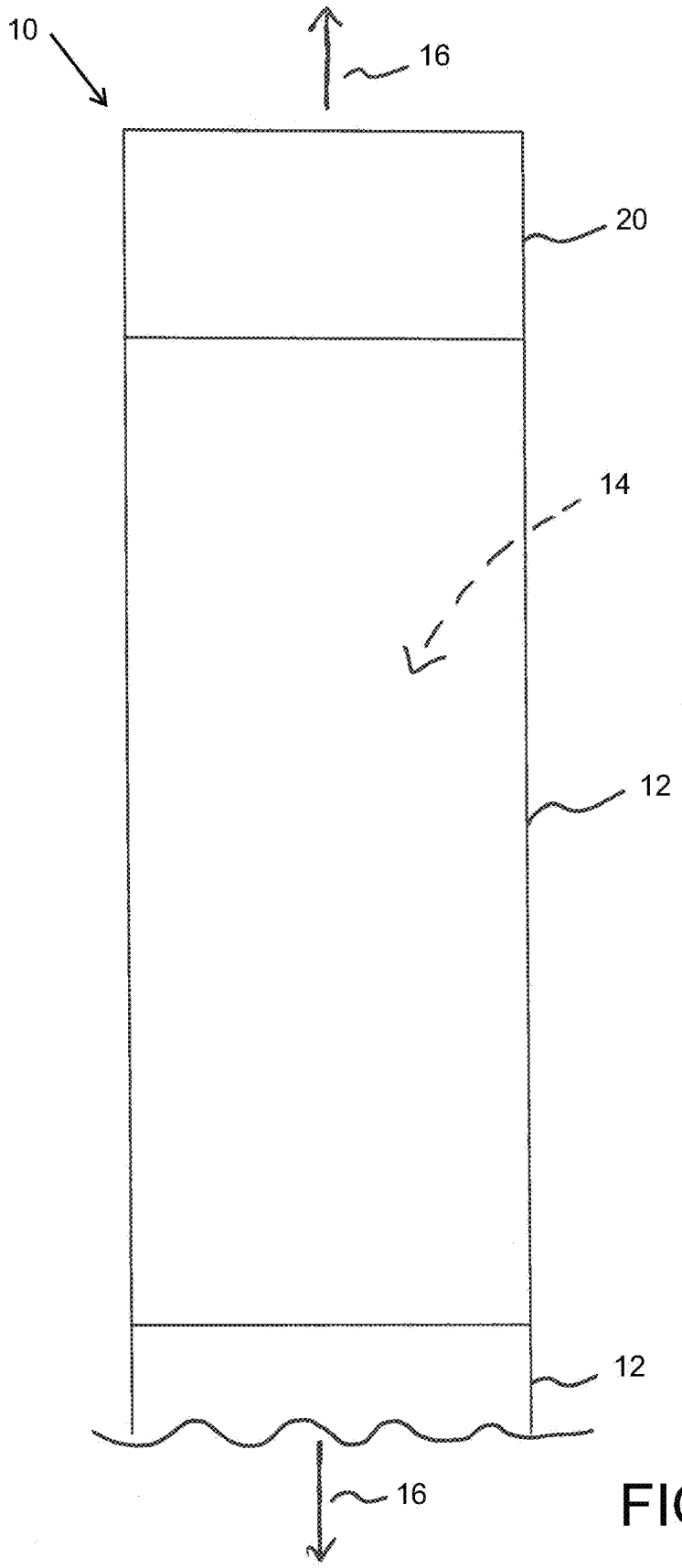
FIG. 2A is a side view of a portion of an exemplary drill string as disclosed herein.
Figure 2B:
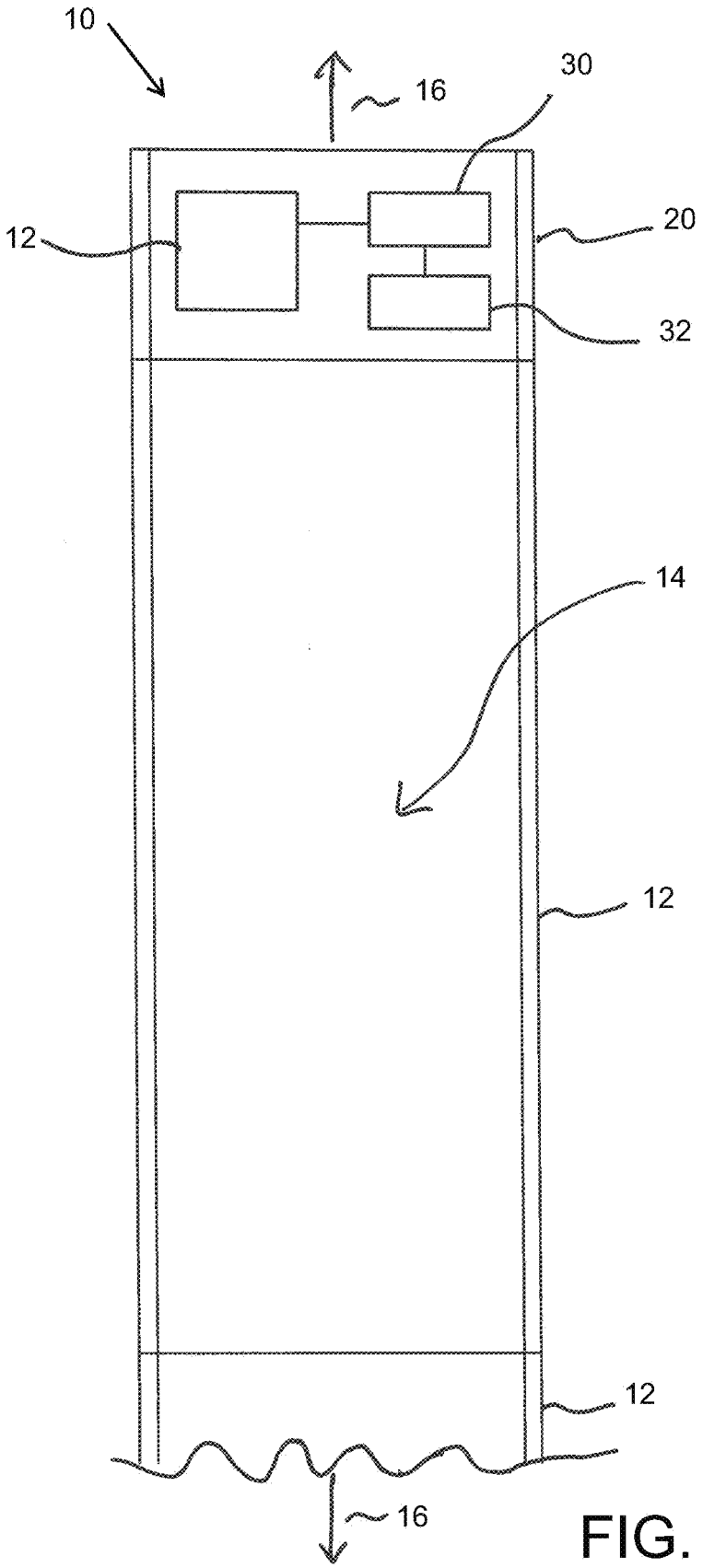
FIG. 2B is a cross-sectional side view depicting the portion of the drill string depicted in FIG. 2A. As shown, the drill string can comprise a proximal adapter that houses processing circuitry as disclosed herein. Optionally, the proximal adapter can be a "wireless sub" as further disclosed herein.
Figure 2C:
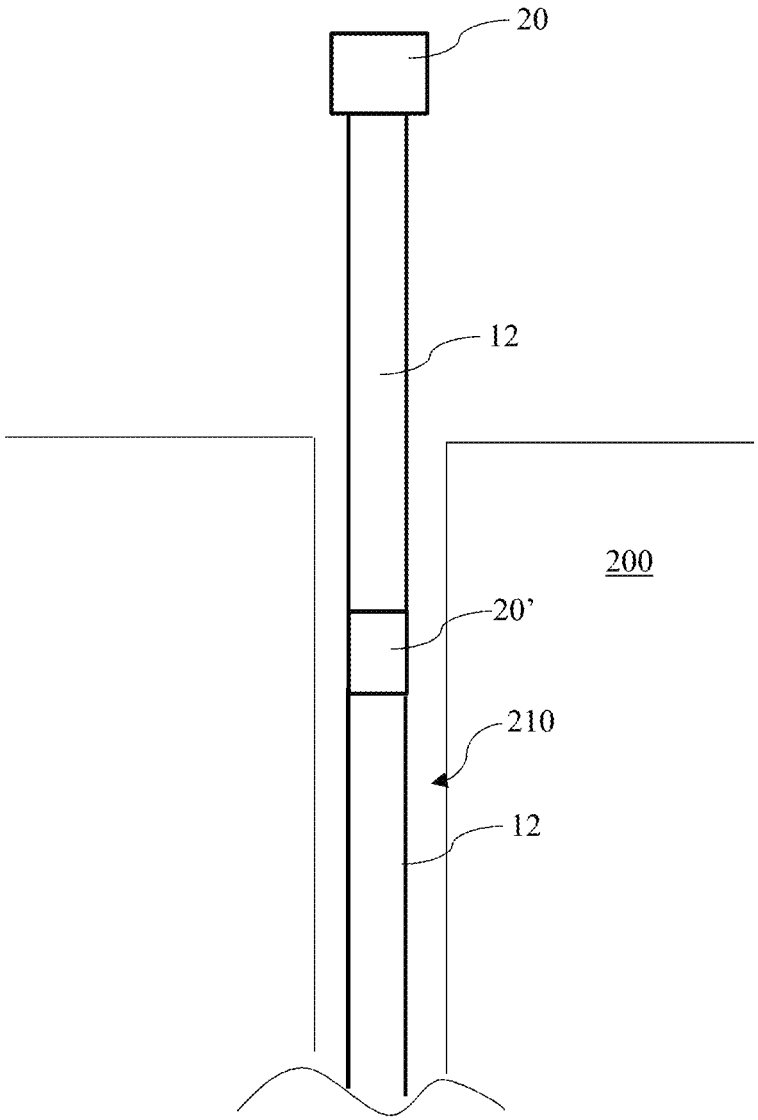
FIG. 2C is a side view of a portion of an exemplary drill string as disclosed herein showing a downhole sub.

In exemplary aspects, the interior 14 of the drill string 10 can be configured to receive wireline tooling as further disclosed herein, an inner tube assembly 40, an outer tube assembly 80, and/or drilling fluid as further disclosed herein. Thus, in exemplary aspects, the adapter can be configured to receive (and permit passage of) the wireline tooling, inner tube assembly, outer tube assembly, and/or drilling fluid as it moves through the drill string 10. Optionally, in some aspects, the adapter can be configured to only permit passage of drilling fluid. In further exemplary aspects, and as shown in FIGS. 2A-2B, the at least one adapter 20 of the drill string 10 can comprise a proximal adapter coupled to a proximal end of the drill string. Optionally, in these aspects, the at least one adapter 20 can comprise only a proximal adapter. In exemplary aspects, the at least one adapter 20 of the drill string 10 can be configured for threaded engagement with one or more drill rods 12 of the drill string in a conventional manner. In further exemplary aspects, it is contemplated that the at least one adapter 20 of the drill string 10 can comprise a plurality of adapters that are axially spaced relative to the longitudinal axis 16 of the drill string, with one or more of the adapters comprising processing circuitry as disclosed herein. In these aspects, it is contemplated that the plurality of adapters can be configured to enhance telemetry impulses in longer drill strings.

In an additional aspect, and with reference to FIGS. 1A-1D and 3A-3B, the inner tube assembly 40 can have a core barrel head assembly 42 and processing circuitry 46. In this aspect, the core barrel head assembly 42 can define an interior cavity 44, and the processing circuitry 46 can be positioned within the interior cavity of the core barrel head assembly. In wireline drilling systems, it is contemplated that the interior of the inner tube assembly 40 can be used to capture samples, whereas the interior cavity of the core barrel head assembly 42, which is separated from the interior of the inner tube assembly 40 that collects the samples, can be a suitable location for the processing circuitry 46. Optionally, in exemplary aspects, it is contemplated that the inner tube assembly can comprise additional processing circuitry positioned at other locations along the longitudinal axis 16 of the drill string 10. Optionally, in further exemplary aspects, it is contemplated that the processing circuitry 46 can be positioned at other locations within the inner tube assembly 40. For example, in non-wireline drilling operations, it is contemplated that the processing circuitry 46 can be positioned distally within the inner tube assembly 40, optionally within a distal string adapter (not shown).

In operation, the processing circuitry 46 of the inner tube assembly 40 can be configured to detect mechanical impulses generated during drilling operations within the borehole 210. For example, the processing circuitry 46 of the inner tube assembly 40 can be configured to detect and process mechanical impulses generated from down-hole tooling interactions or drill string drilling vibrations. It is contemplated that the processing circuitry 46 of the inner tube assembly 40 can be further configured to wirelessly transmit signals indicative of the mechanical impulses to the processing circuitry 46 of the at least one adapter 20 of the drill string 10. In operation, the processing circuitry 22 of the at least one adapter 20 of the drill string 10 can be configured to wirelessly transmit signals indicative of the mechanical impulses to a remote location outside the borehole 210. For example, and with reference to FIG. 7, it is contemplated that the processing circuitry 22 of the at least one adapter 20 of the drill string 10 can comprise a wireless transmitter 25 that is configured to wirelessly transmit signals indicative of the mechanical impulses to a display device 300 positioned outside the borehole 210. In exemplary aspects, the display device 300 can comprise a wireless receiver 310 that is configured to receive the wireless signals generated by the wireless transmitter 25 of the processing circuitry 22 of the drill string 10. Optionally, in these aspects, it is contemplated that the display device 300 can be provided as part of a remote drilling operator station, which can optionally comprise a computing device. In various optional aspects, it is contemplated that the display device 300 can be a portable (e.g., handheld) display device. In exemplary aspects, the wireless transmitter 25 of the processing circuitry 22 of the drill string 10 can be an ultrasonic transmitter that is configured to transmit ultrasonic signals corresponding to the detected mechanical impulses. In these aspects, it is contemplated that the wireless receiver 310 of the display device 300 can be an ultrasonic receiver that is configured to wirelessly receive the ultrasonic signals generated by the wireless transmitter 25 of the processing circuitry 22 of the drill string 10. In use, it is contemplated that the ultrasonic signals generated by the processing circuitry 22 of the drill string 10 can be configured to travel through metallic components of the drilling system 100. Further details directed to use and transmission of ultrasonic signals are disclosed in International Patent Application Publication No. WO/2012/045122, filed Oct. 7, 2011, the entirety of which is hereby incorporated by reference herein. Although the wireless signals described above are ultrasonic and mechanical impulse signals, it is contemplated that other wireless signal formats, such as Wi-Fi, infrared, and BLUETOOTH, can be used. However, in some applications, it is contemplated that these alternative formats can lead to undesired exposure, proximity, and/or line-of-sight requirements that are avoided when using ultrasonic signals and mechanical impulses. For example, it is contemplated that Wi-Fi and BLUETOOTH signals can be difficult to process when a wireline system is drilling with mud (or other drilling fluid). It is further contemplated that that other signal formats (e.g., infrared laser) can be used. For example, infrared laser signals can be particularly beneficial in drilling operations such as, for example, reverse circulation, sonic, and/or air drilling.

Figure 6:
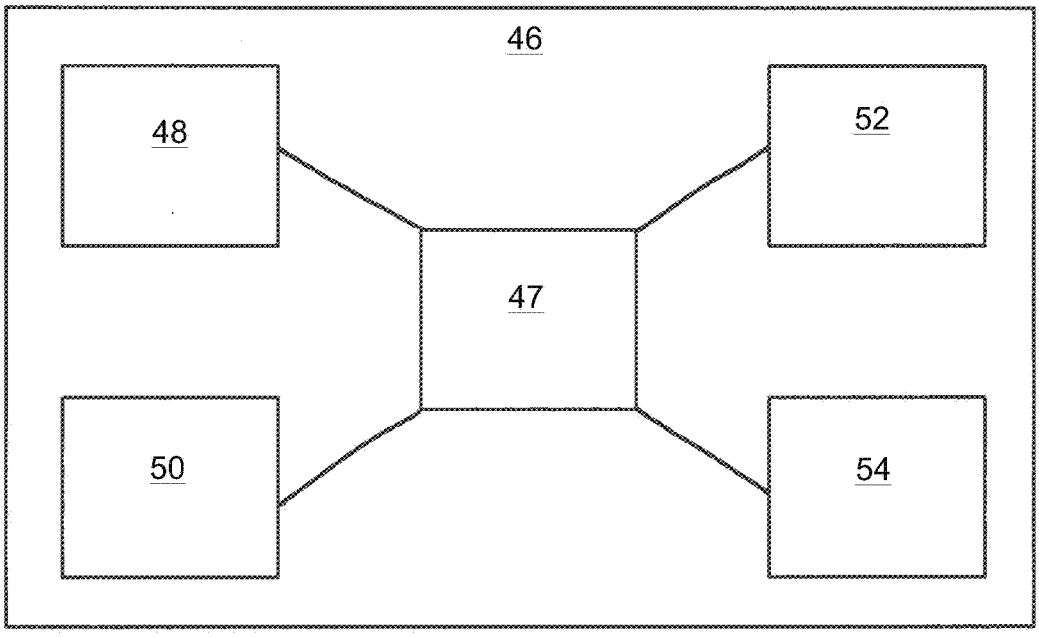
FIG. 6 is a schematic diagram depicting exemplary processing circuitry housed within a core barrel head assembly of an inner tube assembly as disclosed herein.
Figure 7:
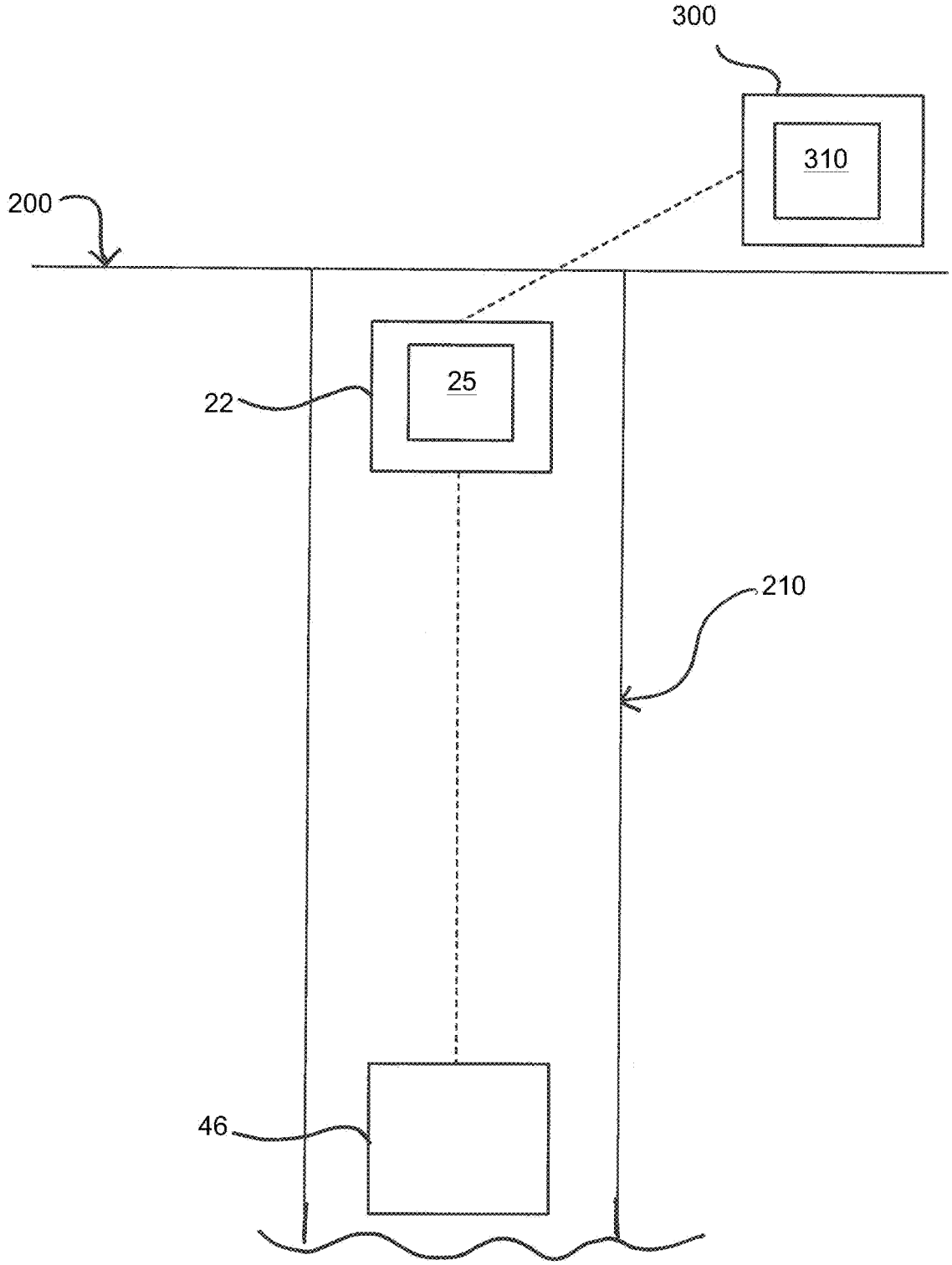
FIG. 7 is a schematic diagram depicting the wireless communication between the processing circuitry of an inner tube assembly, the processing circuitry of a drill string adapter, and a remote display device as disclosed herein.

In exemplary aspects, and with reference to FIG. 6, the processing circuitry 46 of the inner tube assembly 40 can comprise a processor 47, such as, for example and without limitation, a microcontroller. In other aspects, the processing circuitry 46 of the inner tube assembly 40 can comprise at least one accelerometer 48 (e.g., a multi-axis accelerometer) positioned in communication with the processor 47. In additional aspects, the processing circuitry 46 of the inner tube assembly 40 can comprise an electro-mechanical impulse generator 50 positioned in communication with the processor 47 and configured to send mechanical impulse signals to the processing circuitry 22 of the at least one adapter 20 of the drill string 10. Optionally, the processing circuitry 46 of the inner tube assembly 40 can comprise at least one fluid pressure sensor 52 that is positioned in communication with the processor 47 and configured to detect at least one drilling condition as further disclosed herein. Optionally, the processing circuitry 46 of the inner tube assembly 40 can comprise at least one additional measurement device 54 positioned in communication with the processor 47. In exemplary non-limiting aspects, the at least one additional measurement device 54 can comprise at least one temperature sensor and/or at least one gyroscope (e.g., multi-axis gyroscope). Optionally, it is contemplated that the at least one accelerometer 48 can comprise a combined accelerometer and gyroscope.

Figure 3A:
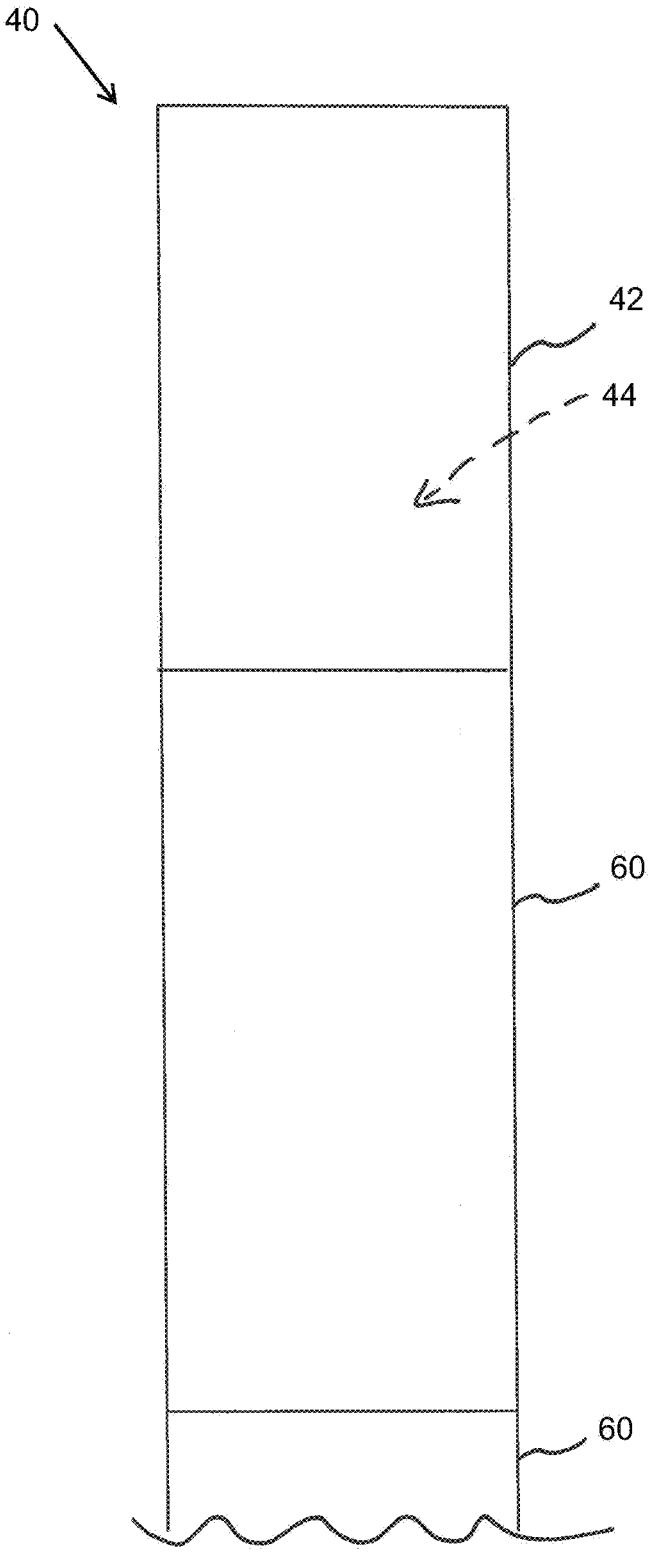
FIG. 3A is a schematic diagram of a side of a portion of an exemplary inner tube assembly as disclosed herein.
Figure 3B:
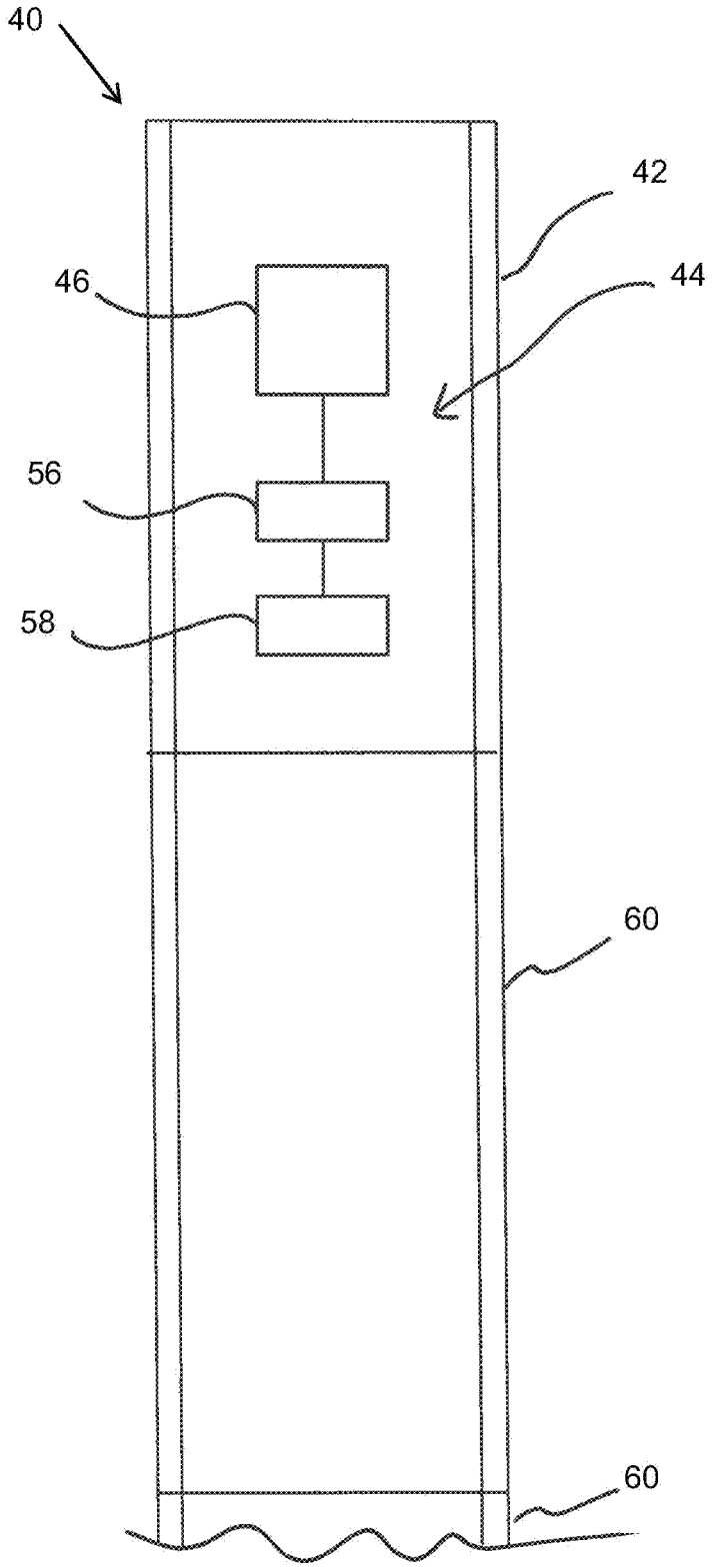
FIG. 3B is a schematic diagram of a side cross-section of the inner tube assembly depicted in FIG. 3A. As shown, the inner tube assembly can comprise a core barrel head assembly that houses processing circuitry as disclosed herein.
Figure 4:
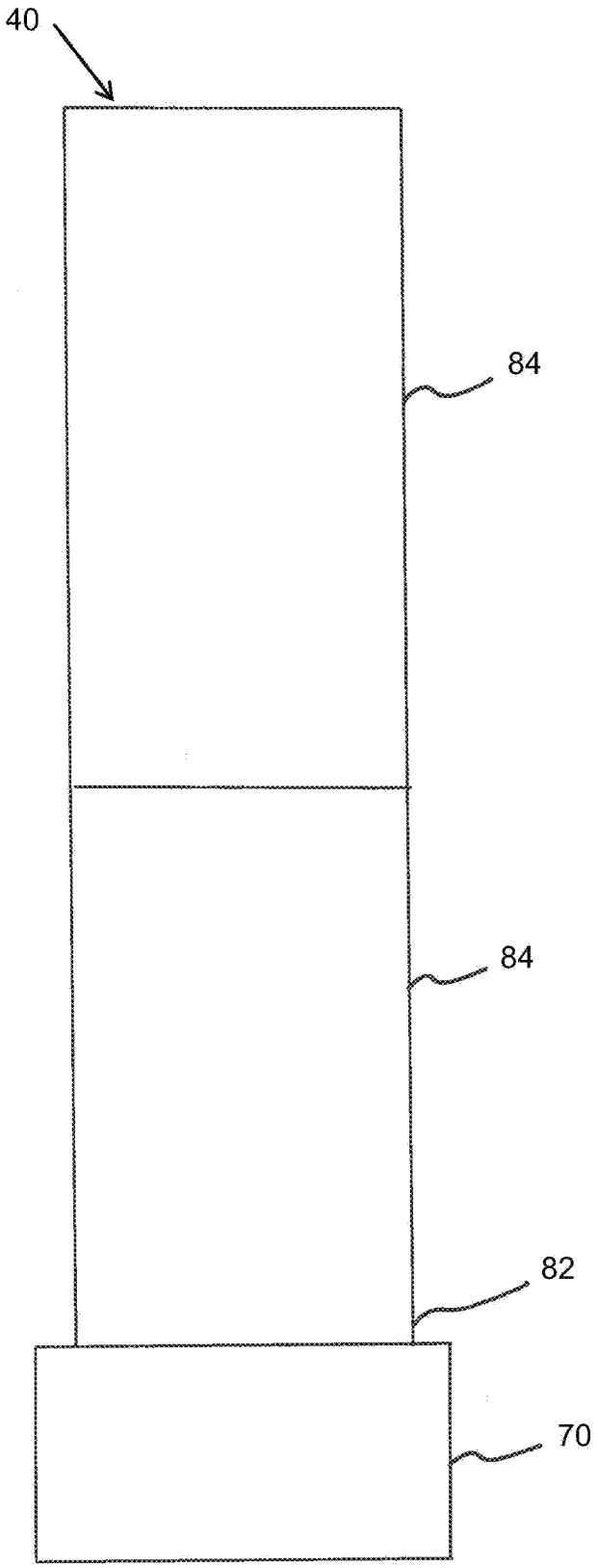
FIG. 4 is a side view of an exemplary outer tube assembly and drill bit as disclosed herein.

In an additional aspect, and as shown in FIG. 3B, the inner tube assembly 40 can comprise a power source 56 positioned in electrical communication with the processing circuitry 46 of the inner tube assembly 40. Optionally, in this aspect, the power source 56 of the inner tube assembly 40 can comprise a battery (e.g., a Lithium ion battery). Optionally, in further aspects, the inner tube assembly 40 can comprise a power generator 58 that is electrically coupled to the power source 56 (e.g., battery) to re-charge the power source during drilling operations. In one optional aspect, the power generator 58 can be a piezoelectric power generator that harvests energy from drilling percussion or vibration (e.g., the vibrations and forces produced by the drill string during drilling operations). In another optional aspect, the power generator 58 can be a turbine generator that is driven by flow of drilling fluid during drilling operations. Thus, in this aspect, it is contemplated that the power generator 58 can be positioned in fluid communication with the drilling fluid during drilling operations. In a further optional aspect, the power generator 58 can be a rotary and brushless-induction generator that is configured to be driven by relative rotational movement between the inner tube assembly and the drill string.

Figure 5:
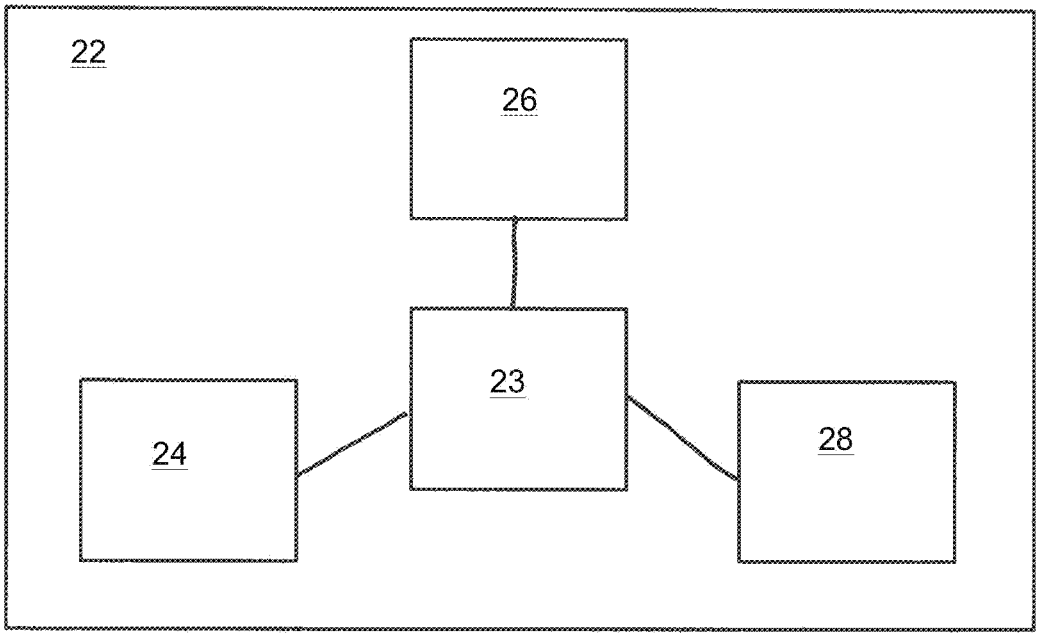
FIG. 5 is a schematic diagram depicting exemplary processing circuitry housed within an adapter of a drill string as disclosed herein.

In further exemplary aspects, and with reference to FIG. 5, the processing circuitry 22 of at least one adapter 20 of the drill string 10 can comprise a processor 23, such as, for example and without limitation, a microcontroller. In other aspects, the processing circuitry 22 of at least one adapter 20 of the drill string 10 can comprise at least one accelerometer 24 (e.g., a multi-axis accelerometer) positioned in communication with the processor 23. Optionally, in additional aspects, the processing circuitry 22 of at least one adapter 20 of the drill string 10 can comprise an electro-mechanical impulse generator 26 that is positioned in communication with the processor 23 and configured to send mechanical impulse signals to the processing circuitry 46 of the inner tube assembly 40. In these aspects, it is contemplated that the processing circuitry 46 of the inner tube assembly 40 can be configured to detect the mechanical impulse signals generated by the electro-mechanical impulse generator 26 of the processing circuitry 22 of the drill string 10. In operation, it is contemplated that the processing circuitry 22 of the at least one adapter 20 of the drill string 10 can be configured to receive control signals from a remote location outside the borehole 210. Optionally, the processing circuitry 22 of the at least one adapter 20 of the drill string 10 can comprise at least one additional measurement device 28 positioned in communication with the processor 23. For example, it is contemplated that the at least one additional measurement device 28 can comprise a temperature sensor and/or a gyroscope (e.g., a multi-axis gyroscope). Optionally, it is contemplated that the at least one accelerometer 24 can comprise a combined accelerometer and gyroscope.

In an additional aspect, each adapter 20 of the drill string can comprise a power source 30 positioned in electrical communication with the processing circuitry 22 of the adapter. Optionally, in this aspect, the power source 30 of at least one adapter 20 of the drill string 10 can comprise a battery (e.g., a Lithium ion battery). Optionally, in a further aspect, at least one adapter 20 of the drill string can comprise a power generator 32 that is electrically coupled to the power source 30 (e.g., battery) to re-charge the power source during drilling operations. In one optional aspect, the power generator 32 can be a piezoelectric power generator that harvests energy from drilling percussion or vibration (e.g., the vibrations and forces produced by the drill string during drilling operations). In another optional aspect, the power generator 32 can be a turbine generator that is driven by flow of drilling fluid during drilling operations. Thus, in this aspect, it is contemplated that the power generator 32 can be positioned in fluid communication with the drilling fluid during drilling operations. In a further optional aspect, the power generator 32 can be a rotary and brushless-induction generator that is configured to be driven by relative rotational movement between the inner tube assembly and the drill string.

In use, it is contemplated that the processing circuitry 22 of the at least one adapter 20 of the drill string 10 and/or the processing circuitry 46 of the inner tube assembly 40 can be configured to determine the occurrence of at least one drilling condition, such as a tooling diagnostic alert and/or a drilling process event, which can optionally be associated with particular accelerations, pressures and/or temperatures within the drill string. In one aspect, the at least one detected drilling condition can comprise an inner tube landing position. In another aspect, the at least one detected drilling condition can comprise an inner tube latch mechanism position. In an additional aspect, the at least one detected drilling condition can comprise an inner tube fluid control valve position. In a further aspect, the at least one detected drilling condition can comprise a drilling fluid flow rate. In another aspect, the at least one detected drilling condition can comprise drilling pressure. In yet another aspect, the at least one detected drilling condition can comprise a drill string load impulse. In still another aspect, the at least one detected drilling condition can comprise a fully worn drill bit. In still another aspect, the at least one detected drilling condition can comprise excessive down-hole vibration. In still another aspect, the at least one detected drilling condition can comprise a blocked sample within an inner tube. In still another aspect, the at least one detected drilling condition can comprise a full inner tube. In still another aspect, the at least one detected drilling condition can comprise a sticking inner tube bearing. In still another aspect, the at least one detected drilling condition can comprise a failing inner tube bearing. In still another aspect, the at least one detected drilling condition can comprise low bearing grease pressure. In still another aspect, the at least one detected drilling condition can comprise high bearing grease pressure. In operation, it is contemplated that the processing circuitry used to determine particular drilling conditions can vary depending on the type of drilling operations being performed. For example, during wireline drilling systems, it is contemplated that the inner tube head assembly can include sensors that would likely be positioned in a distal drill string adapter in other drilling systems.

In exemplary aspects, the alert conditions associated with the tooling diagnostic alerts and/or drilling process events can be pre-programmed into the processing circuitry 22, 46 or in a remote computing device (e.g., a remote handheld device) as specific ranges of changes in magnitude or of change patterns, and the rates of speeds in which those changes occur. In these aspects, the alert conditions can be based on individual parameters or combinations of parameters measured by one or more sensors as disclosed herein. For example, grease pressure alerts can require a pressure sensor exposed to a grease housing within the drilling system. As described above, it is contemplated that the alert conditions can optionally be stored in the inner tube processing circuitry, the adapter processing circuitry, and/or in a remote hand-held device. Similarly, the processing (comparing conditions to the detected parameter values that are detected and transmitted) can optionally occur at any of these locations. Optionally, it is contemplated that certain portions of condition storing and comparison processing can be distributed among the various processing locations within the drilling system to maximize efficiency and/or to meet space or power limitations. Alternatively, it is contemplated that certain storing and processing capabilities can be duplicated at multiple points for redundancy and system reliability.

It is further contemplated that the processing circuitry 22 of the at least one adapter 20 of the drill string can be configured to determine the times at which mechanical impulse data is detected by the processing circuitry 46 of the inner tube assembly 40. In exemplary aspects, at least one of the processing circuitry 22 or the processing circuitry 46 can comprise a clock that provides time information to the processing circuitry 22. Thus, the processing circuitry 22 can use the time information provided by the clock to determine the times at which mechanical impulse data is detected by the processing circuitry 46 of the inner tube assembly 40. In exemplary aspects, it is contemplated that the clock can be a 25 MHz or a 4 GHz clock for establishing the times of events within electronic systems as is known in the art. Optionally, in exemplary aspects, the processing circuitry 22 can be configured to be driven entirely by the clock in checking the outputs of one or more of the sensors disclosed herein. Alternatively, it is contemplated that the processing circuitry 22 can communicate with the clock to establish an interrupt-driven system for checking the outputs of one or more of the sensors disclosed herein.

In exemplary aspects, the drilling system 100 can further comprise a drill bit 70. Optionally, in these aspects, the drill bit 70 can be operatively coupled to a distal end of the drill string 10. Alternatively, in these aspects, the drilling system 100 can further comprise an outer tube assembly 80 having a distal end 82 that is operatively coupled to the drill bit 70. It is contemplated that the outer tube assembly 80 can comprise at least one outer tube 84 as is known in the art.

In further exemplary aspects, it is contemplated that the inner tube assembly 40 can comprise at least one inner tube (core barrel) 60 positioned between the core barrel head assembly 42 and the drill bit 70 relative to the longitudinal axis 16 of the drill string 10.

In use, the disclosed drilling system can perform a drilling method. In exemplary aspects, the drilling method can comprise conducting a drilling operation within a borehole using the drilling system. In additional aspects, the drilling method can comprise detecting mechanical impulses using the processing circuitry of the inner tube assembly. In other aspects, the drilling method can comprise using the processing circuitry of the inner tube assembly to wirelessly transmit signals indicative of the detected mechanical impulses to the processing circuitry of the drill string. In further aspects, the drilling method can comprise using the processing circuitry of the drill string to receive the signals transmitted by the processing circuitry of the inner tube assembly. In still further aspects, the drilling method can comprise using the processing circuitry of the drill string to wirelessly transmit signals indicative of the mechanical impulses to a remote location outside the borehole.

Optionally, in exemplary aspects and as further disclosed herein, it is contemplated that the processing circuitry of the inner tube assembly and the processing circuitry of the drill string can be configured for two-way wireless communication. For example, in these aspects, it is contemplated that each set of processing circuitry can be configured to generate and transmit mechanical impulses that are received and processed by the other set of processing circuitry.

Figure 8:
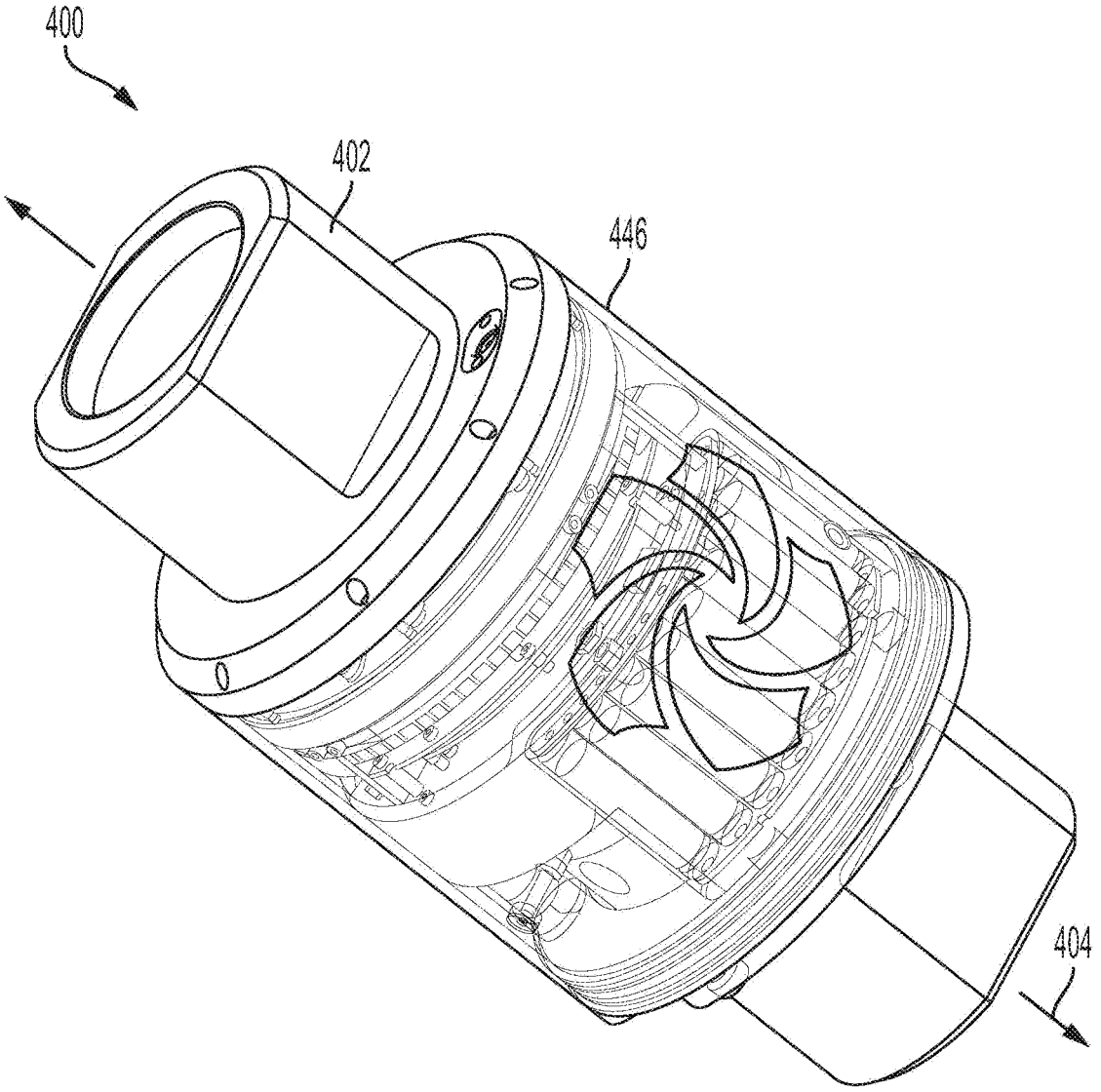
FIG. 8 is a perspective view of a wireless sub in accordance with embodiments disclosed herein.
Figure 9:
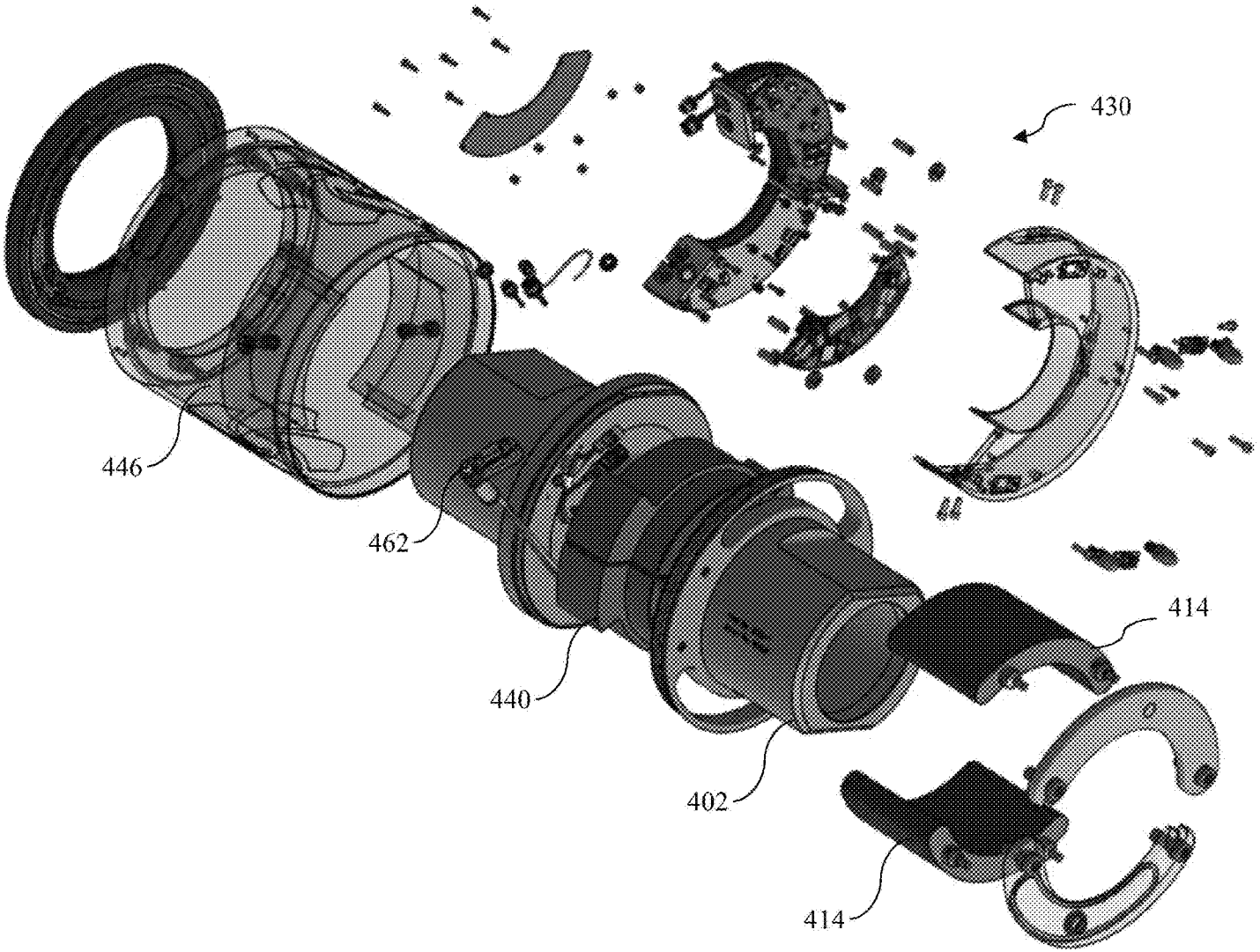
FIG. 9 is an exploded view of the wireless sub as in FIG. 8.
Figure 10:
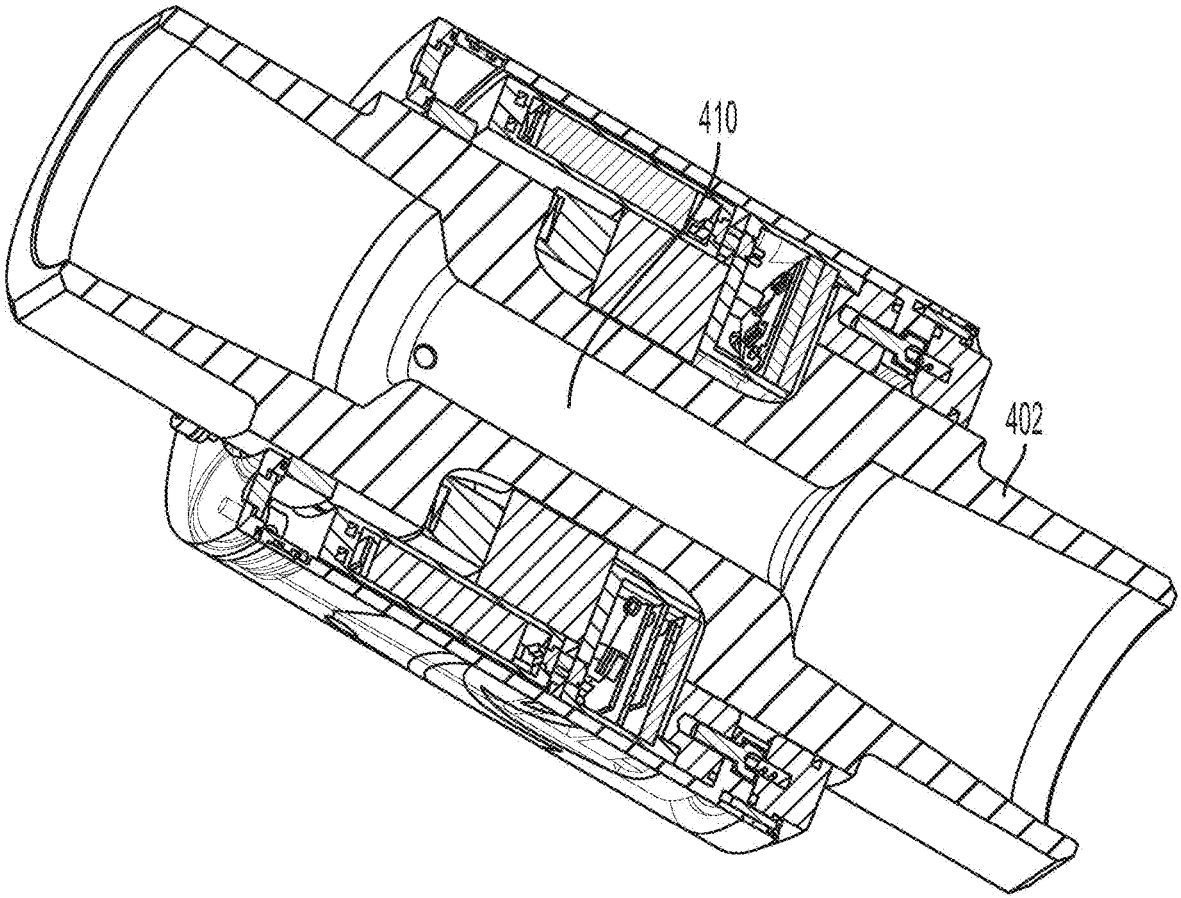
FIG. 10 is a sectional perspective view of the wireless sub as in FIG. 8.

Referring to FIGS. 8-10, according to some aspects, a wireless sub 400 can attach to the drill string at or near the proximal end of the drill string. In these aspects, it is contemplated that the wireless sub 400 can serve as a particular form of adapter 20, as described above with respect to FIGS. 1A-7. Optionally, the wireless sub 400 can be used in conjunction with processing circuitry of the inner tube assembly as described above. However, it is contemplated that the wireless sub 400 can be used regardless of whether such processing circuitry is provided within the inner tube assembly.

The wireless sub 400 can comprise various sensors for monitoring various aspects of drilling and drilling-associated activities, such as, for example, core retrieval. In some aspects, mounting the wireless sub 400 in-line allows for detecting drill string mechanical impulses, such as, for example, axial and torsional vibrations resulting from dynamic load response. These axial and torsional vibrations can be associated with vibrational signatures that correspond to various operating conditions, such as a likelihood of drill string deformation. Accordingly, measured vibrations can provide information including, but not limited to, an indication of imminent permanent twisting deformation overload. An operator can receive an indication of such vibrational signatures and stop drilling or change the drilling parameters to prevent damage to the drill string. As should be understood, in further aspects, mechanical impulses detected by the wireless sub 400 are not limited to vibrations.

According to some aspects, the wireless sub 400 can couple to the drill string via an adapter sub or with one or more quick-attach adapter subs. A direct coupling of the wireless sub 400 to the drill string (so that the wireless sub 400 forms part of the drill string) enables the wireless sub to measure the vibrations of the drill string. Optionally, the wireless sub 400 can attach to the drill string below the drill rig's top drive unit or to a "Kelly rod" in a hollow-spindle chuck-drive unit. As should be understood, a Kelly rod is a drill rod that is maintained at the top of the drill string while additional drill rods are added or subtracted below it. In some optional aspects, the wireless sub 400 can be mated directly to the Kelly rod. In further aspects, an adapter sub can couple a drilling unit of a top-drive drill rig to the wireless sub 400. Vibrations of the drill rig can be dampened through the top-drive unit and drill string adapter sub (e.g., adapter subs for top-drive rigs) or through the chuck-drive and Kelly rod. Accordingly, the wireless sub 400 can be at least partially isolated (or completely or substantially completely isolated) from the vibrations of the drill rig. This configuration can be contrasted with, for example, vibration sensors in a floating sub that receive vibrations from the drill rig, which mask the vibrations from the drill string and inhibit detection of drill string vibrational signatures.

According to some aspects, the wireless sub 400 can be maintained outside of the borehole 210 throughout a drilling or mining operation. That is, during drill string makeup, drill rods can be added distally of the wireless sub 400. In maintaining the wireless sub 400 outside of the borehole, the wireless sub 400 is not constrained to a maximum diameter that is less than that of the borehole. Rather, the wireless sub 400 can optionally have a diameter that is greater than the operative diameter of the drill bit or greater than the operative diameter of the borehole. Accordingly, the wireless sub can be sufficiently rigid and can be packaged with sufficient batteries for a long battery life. Further, in maintaining the wireless sub at the proximal end of the drill string and outside the borehole, the wireless sub can optionally maintain constant direct communication with a remote computing device.

Figure 15A:
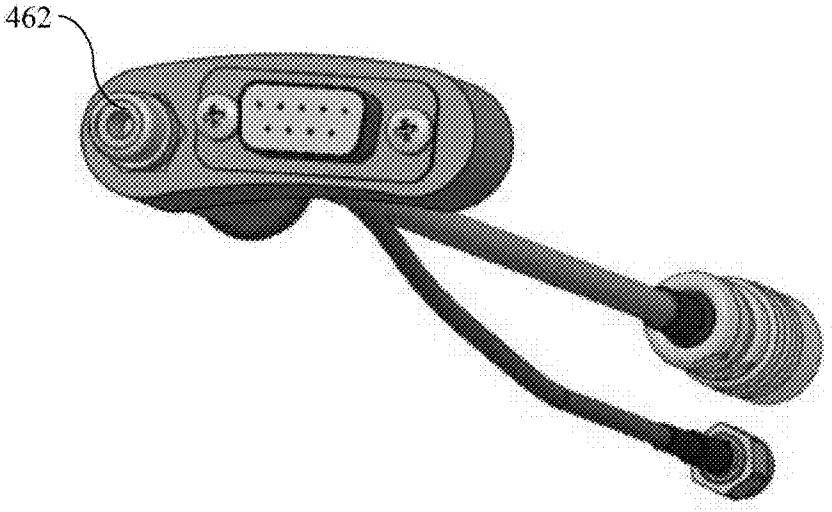
FIG. 15A is a perspective view of a communication port and power port for use with the wireless sub as in FIG. 8.
Figure 15B:
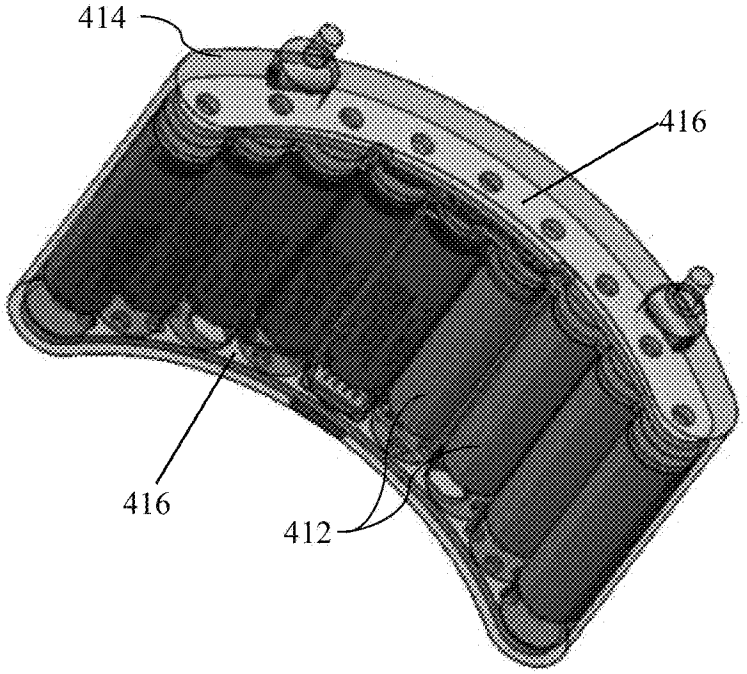
FIG. 15B is perspective view of a battery module for use with the wireless sub as in FIG. 8.

Referring to FIG. 15B, the wireless sub 400 can comprise replaceable rechargeable batteries 412 (e.g., lithium ion batteries) that can be within one or more removable modules 414. The modules can comprise a plurality of batteries that are positioned within a housing. The housing can be opened to access the batteries. Optionally, the housing can be assembled via a plurality of screws (e.g., four). The battery module can be sealed with O-rings for water and moisture resistance. In maintaining the wireless sub 400 outside of the borehole, the batteries can easily be accessed for replacement. Optionally, the wireless sub 400 can be removed from the drill string for battery replacement or further service. The battery cells can be completely encased in a polymer overmold. Battery modules can comprise metal strengthening ribs 416 at each end. The strengthening ribs can be configured to maintain respective positions between batteries in the battery module and prevent excessive deformation (and prevent breaking) of a housing of a removable module 414. The battery modules can have on-board protection and charge state monitoring. Power and data from the batteries can be transferred via connectors, such as, for example and without limitation, D-subminiature connectors. Two or more modules can be wired in parallel. In this way, the modules can be hot-swapped. That is, the wireless sub 400 can continue to draw power from batteries of a first module while the batteries of a second module (that is wired in parallel to the first module) are replaced.

It is contemplated that corresponding elements of the wireless sub 400 for protecting the electronics can be included in the inner tube assembly for protecting the inner tube assembly electronics and in the downhole sub(s) for protecting their electronics. For example, the batteries/battery modules of the inner tube assembly and downhole subs can be sealed and can be configured with on-board protection and charge state monitoring. Similarly, the inner tube assembly and downhole subs can optionally comprise desiccant packets for keeping the electronics dry, thereby protecting against corrosion. The electronics of the inner tube assembly and downhole subs can optionally be maintained within a sealed compartment (optionally, sealed via O-rings or other such seals) to protect against moisture. Further, the batteries of the inner tube assembly and downhole subs can optionally be encased in a polymer over-mold and/or reinforced with strengthening ribs.

Referring also to FIG. 15A, in some optional aspects, the wireless sub 400 can be configured to receive battery charge without removing the wireless sub from the drill string. For example, in some optional aspects, the wireless sub 400 can comprise electrical contacts 462 that can be exposed to charge the batteries while the wireless sub is coupled to the drill string. The wireless sub can further comprise a cover that can selectively cover the electrical contacts when the electrical contacts are not in use. In further optional aspects, the wireless sub 400 can be configured for wireless charging (e.g., via electromagnetic resonant inductive charging) while the wireless sub is coupled to the drill string.

Figure 11:
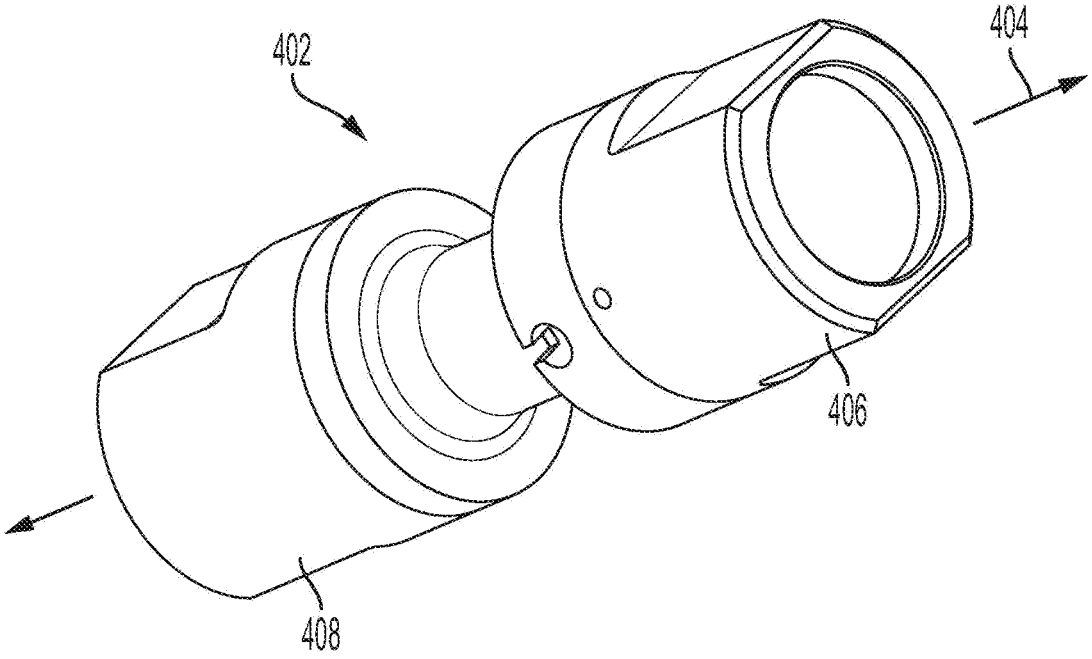
FIG. 11 is a perspective view of a body of the wireless sub as in FIG. 8.
Figure 12:
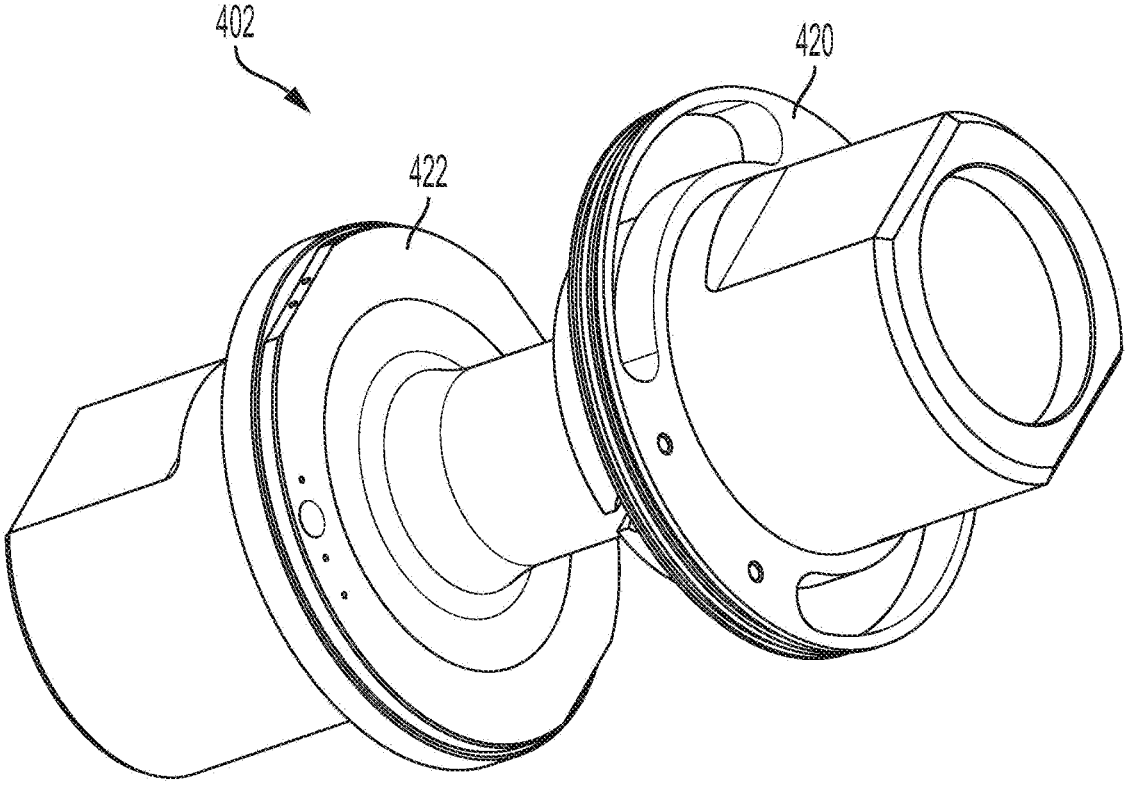
FIG. 12 is a perspective view of the body of the wireless sub as in FIG. 8 with flanges welded thereon.

Referring to FIGS. 10 and 11, the wireless sub 400 can comprise a body 402 having a longitudinal axis 404. The body 402 can comprise a proximal end 406 and a distal end 408 that are each configured for attachment to respective components. For example, the proximal end 406 and the distal end 408 can comprise internal flush (IF) threads (optionally, 3½ inch IF threads) or other suitable coupling means. The body can define an internal bore 410 for fluid communication therethrough. Optionally, referring to FIG. 12, flanges 420 and 422 can be welded to the body 402. In this way, the body can be manufactured more easily and efficiently than machining the body to provide the flanges.

Figure 13:
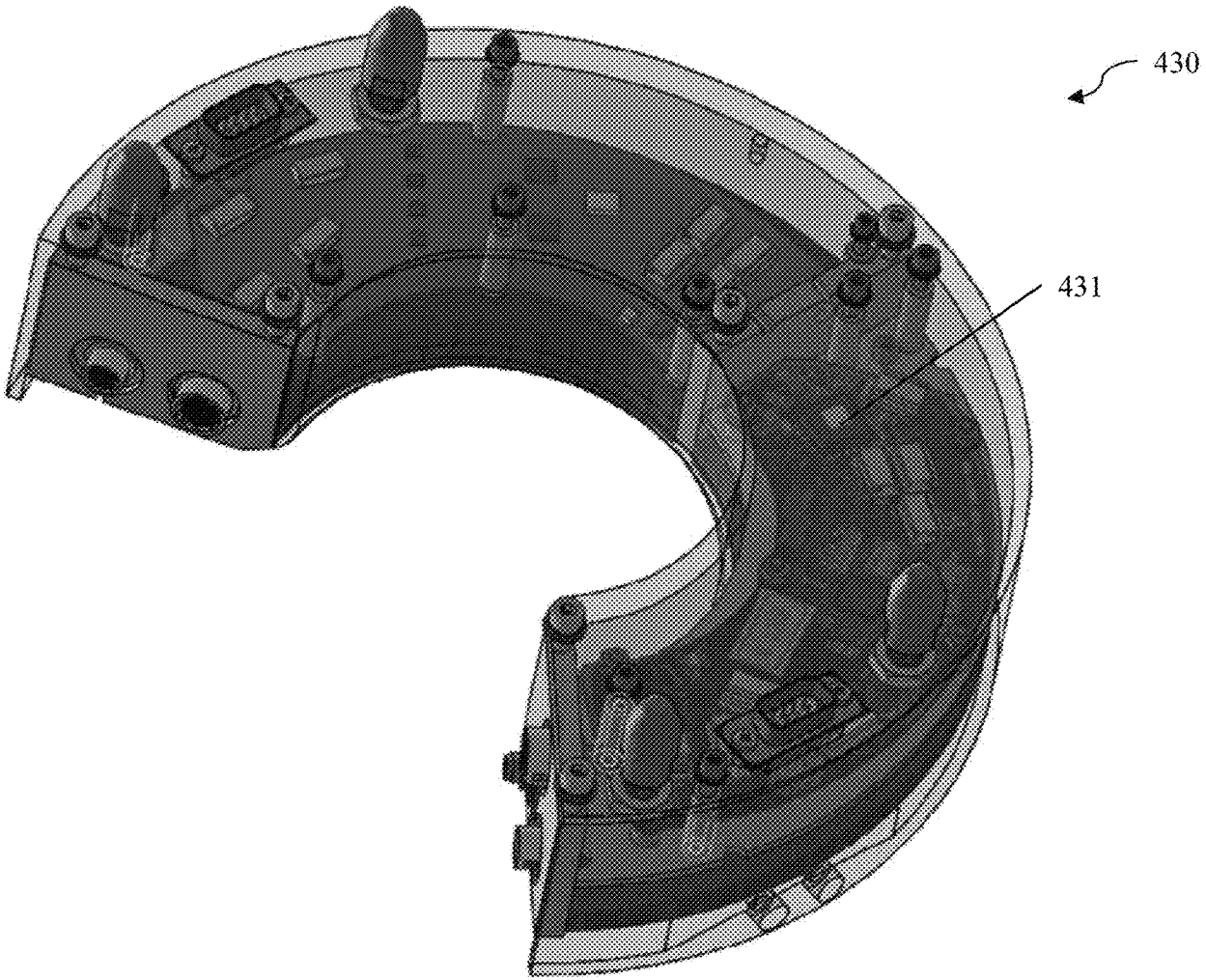
FIG. 13 is a perspective view of an electronics module of the wireless sub as in FIG. 8.

Referring to FIGS. 9 and 13, the wireless sub can comprise an electronics module 430 comprising a controller 431 and memory. The electronics module can further comprise mechanical impulse sensors, such as, for example, piezoelectric sensors. The mechanical impulse sensors (or other vibrational sensors) can be positioned with respect to the longitudinal axis 404 and to each other in order to detect axial and rotational vibrations that propagate through the drill string. The electronics module can further comprise a wireless module for communication with a remote computing device 500 (e.g., a smartphone, tablet, personal computer, or custom computing device). For example, vibrational data can be communicated to the remote computing device 500.

Figure 16:
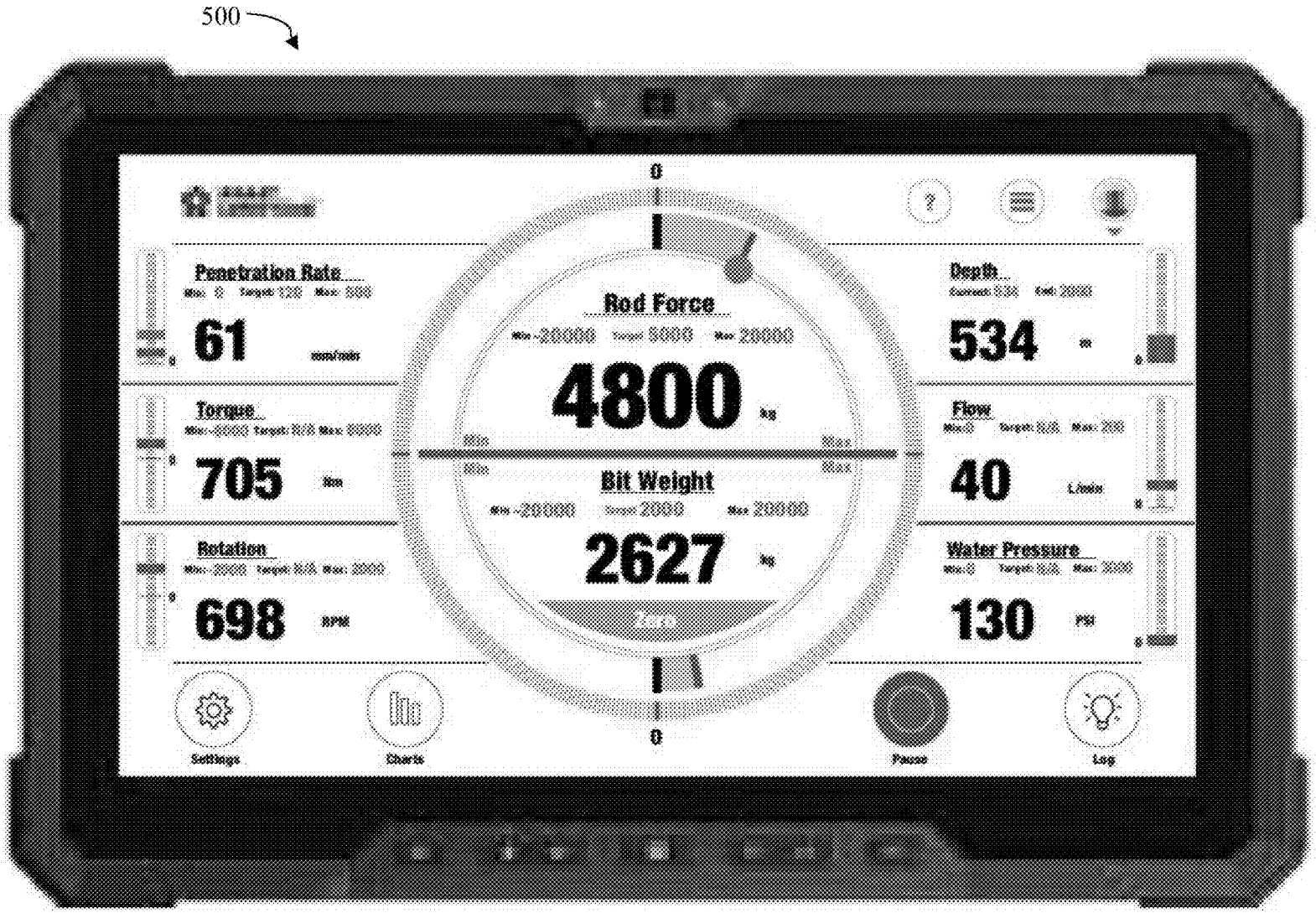
FIG. 16 illustrates a remote computing device in communication with the wireless sub as in FIG. 8, the remote computing device showing a user interface.

Referring to FIG. 16, a remote computing device 500 can provide an interface for providing information to the operator. Optionally, the remote computing device 500 can receive an input from the operator (e.g., via a touchscreen, keypad, or other input device) and communicate said input to the wireless sub 400. For example, the remote computing device 500 can optionally receive operator input to adjust settings on the wireless sub 400 or poll the wireless sub 400 for data. The remote computing device 500 can receive additional information from other sources such as sensors on the drill rig.

In various optional aspects, the remote computing device 500 can display information such as, for example, weight on bit, rod force, torque on bit, drilling fluid pressure, rotational speed, penetration rate, fluid flow rate, and depth. The remote computing device 500 can receive operator inputs such as, for example, depth, drilling status, and miscellaneous event logs. Optionally, the event logs can be automatically associated with a depth and/or time. The remote computing device can further report metrics (optionally, automatically), such as, for example, average torque, average fluid pressure, average rotation speed, average weight on bit, average penetration rate, and/or average fluid flow rate. Such information, inputs, and metrics can be provided in a conventional fashion, based on outputs and/or signals received from various sensors and/or determinations made by a processor of a computing device (e.g., the remote computing device 500).

The electronics module 430 can have an arcuate shape (e.g., a C-shape) to fit over the central spindle of the body 402. The electronics module can comprise components (e.g., printed circuit assays) supported via semi-flexible stand-offs. It is contemplated that the semi-flexible stand-offs can protect the electronics module (e.g., printed circuit assays) from vibrations by absorbing or dampening vibrations that would otherwise reach the components of the electronics module. Shielding can be integrated within or around the electronics module to prevent electromagnetic interference.

Figure 14A:
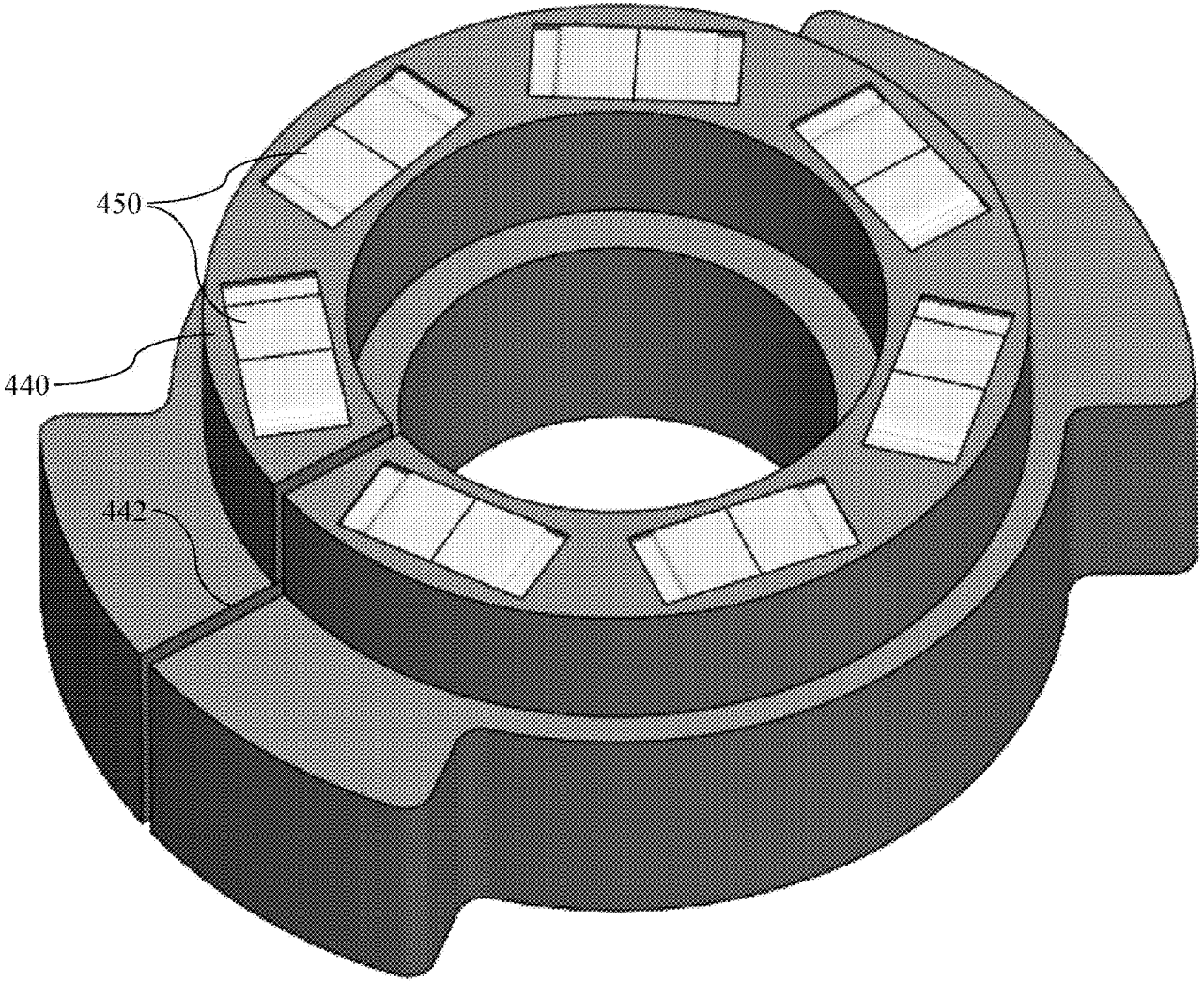
FIG. 14A is a perspective view of a foam insert and silica gel desiccant packs of the wireless sub as in FIG. 8.
Figure 14B:
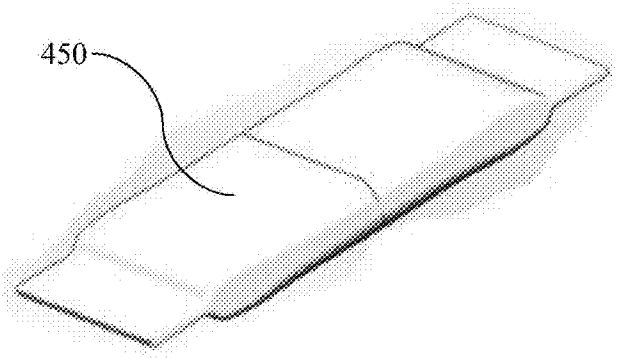
FIG. 14B is a perspective view of the silica gel desiccant.

Referring to FIGS. 9 and 14, the wireless sub 400 can comprise a foam insert 440, which can optionally comprise silica gel desiccant packs 450 embedded within the insert 440 or received within receptacles of the foam insert. The foam insert 440 can comprise a slit 442 for enabling the foam insert to deform for assembly of the wireless sub. The foam insert 440 can fill or substantially fill unwanted air (e.g., displace air) in the wireless sub, thereby minimizing moisture therein. The desiccant packs 450 can remove moisture from the wireless sub, thereby limiting the risk of corrosion.

Referring to FIGS. 8-10, the wireless sub 400 can comprise a cylindrical cover 446. The cylindrical cover can be fixed at one end to prevent rotation about the longitudinal axis. The cylindrical cover can comprise a material of strength and thickness to bear lateral loads applied to the wireless sub. Suitable materials can include polymer or metal materials, such as, for example, cold-rolled or hardened steel sheets. The cover can attach to the body via two shoulder screws for secure attachment with easy removability. The cover can comprise transparent windows (e.g., comprising polycarbonate) to provide visibility into the wireless sub.

According to various aspects, screws in the wireless sub can be fitted with locking washers to inhibit undesired unscrewing. Optionally, the wireless sub can comprise a polymer aerial ring that can be completely sealed via O-rings.

Figure 15C:
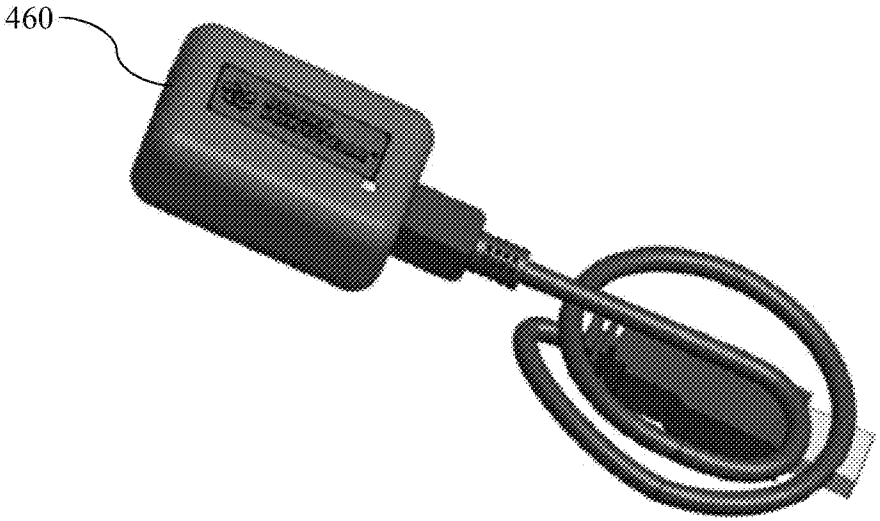
FIG. 15C is a dongle for use with the wireless sub as in FIG. 8.
Figure 15D:
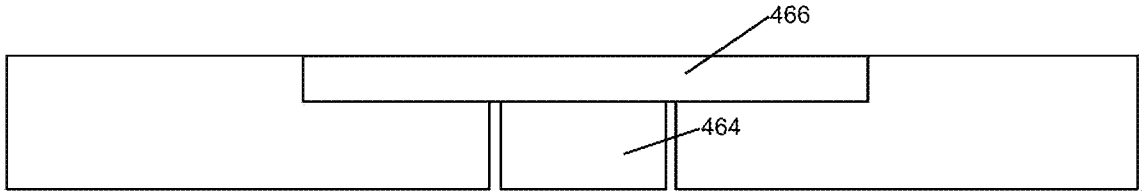
FIG. 15D is a schematic of a recessed button with a silicone cover of the wireless sub as in FIG. 8.

Referring to FIG. 15D, the wireless sub can comprise a power switch 464 that is recessed and protected from moisture and dirt via a flexible polymer cover 466. The wireless sub can comprise a power switch LED. The LED can be in communication with the controller of the electronics module, and the controller can cause the LED to flash in various colors and/or patterns to indicate different operational states (e.g., low battery). For example, it is contemplated that the controller can cause the LED to flash in particular colors and/or patterns to indicate charging status, charge level, power status, communication status, communication signal status or level, alarm status, error indications, and the like.

Referring to FIG. 15C, a dongle 460 can be encapsulated in polymer and associated with the wireless sub 400. The dongle 460 can enable wireless communication between the wireless sub 400 and a remote computing device 500 as further disclosed herein.

Referring to FIGS. 8-16, in addition to measuring and processing vibrational patterns of the drill string, the wireless sub 400 can track other metrics. For example, as shown, the wireless sub 400 can detect when the drill string is engaged in drilling. In exemplary aspects, drilling can be detected by determining that one or multiple thresholds (e.g., rotational speed, thrust load, tension load, and/or vibration levels) have been exceeded or by matching patterns of multiple sensor outputs, such as a combination of sensor outputs that are indicative of rotational speed, thrust load, tension load, and/or vibration levels, and the like.

Accordingly, time of drilling can be compared to time during which the drill rig is not being used for drilling. Thus, productivity metrics can be provided and monitored. With this information, optimal performance conditions can be determined. Further, performance can be compared between multiple different holes that can, optionally, be drilled with different rigs, etc. Data from the remote computing device 500 can optionally be provided to another computing device (e.g., a server) for compiling, filtering, further processing, etc.

Optionally, in some embodiments, the wireless sub 400 can be in communication with a downhole sub (or adapter) 20' (FIG. 2C) that is integrated in the drill string and positioned within the borehole. Optionally, the downhole sub can be positioned near the distal end of the drill string. The downhole sub can comprise mechanical impulse/vibration sensors (e.g., vibration accelerometer(s)) that can optionally be structurally similar to those of the wireless sub 400. Additionally, or alternatively, it is contemplated that the downhole sub 20' can optionally comprise other sensor types, such as, for example and without limitation, a load or strain sensor and/or a proximity sensor (e.g., inductive or resistive). The downhole sub can further be in communication with the wireless sub 400 (e.g., via wireless communication) for communicating vibrational and other captured data. Because the downhole sub is proximate to the bit, the vibrational data that the downhole sub captures can provide information about the drill bit (e.g., the sharpness of the bit, or whether bit sharpening is occurring) as well as properties of the formation (e.g., whether the bit is in mud or in a rocky formation). Accordingly, the downhole sub can provide further information to supplement the data captured via the wireless sub.

Additionally, the downhole sub can capture tooling information, such as, for example, if and when the inner tube assembly has passed therethrough. For example, it is contemplated that downhole sub 20' can comprise a sensitive load sensor or a proximity sensor (inductive or resistive) that is capable of providing an output that is indicative of a passing or mating/seated inner tube assembly. In this way, the downhole sub can inform the operator if an inner tube assembly is stuck or if an inner tube assembly is in position at the distal end of the drill string.

Still further, in some optional aspects, the inner tube assembly 40 can be in communication with the wireless sub 400. Mechanical impulses detected from the processing circuitry 46 of the inner tube assembly 40, and other information that the inner tube assembly captures, can be transmitted to the wireless sub 400.

Accordingly, vibrational signatures captured by two or all of the wireless sub 400, inner tube assembly 40, and the downhole sub can cooperate to provide information of the drilling conditions to the operator.

Computing Device

Figure 17:
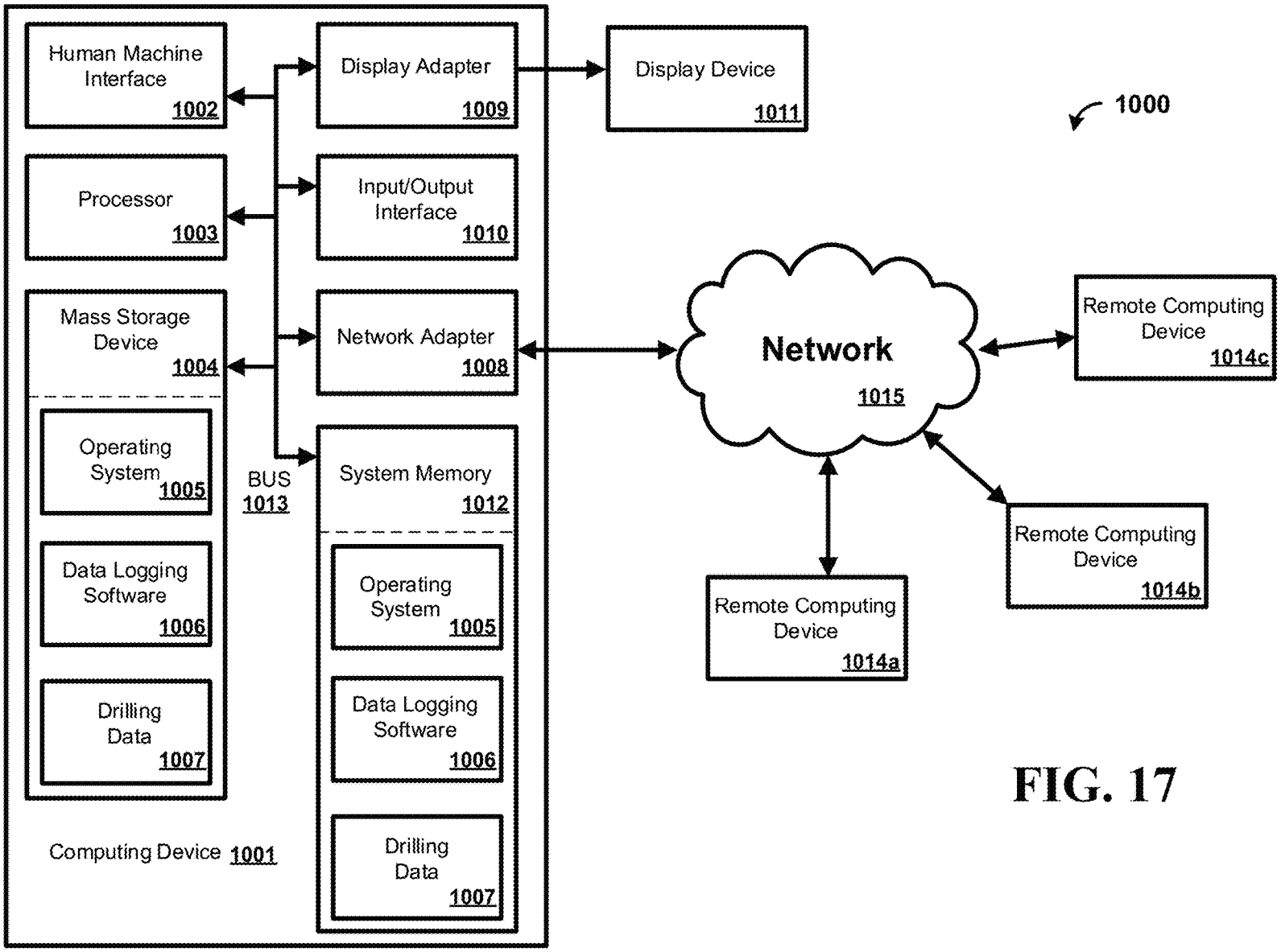
FIG. 17 is an exemplary environment comprising a computing device in accordance with embodiments disclosed herein.

FIG. 17 shows a computing system 1000 including an exemplary configuration of a computing device 1001 for use with the drilling system 100. In some aspects, the computing device 1001 can be embodied as the remote computing device 500 (FIG. 16), as disclosed herein. In further aspects, it is contemplated that a separate computing device, such as, for example, a tablet, laptop, or desktop computer can communicate with the system 100 and can enable the operator to interface with the system 100.

The computing device 1001 may comprise one or more processors 1003, a system memory 1012, and a bus 1013 that couples various components of the computing device 1001 including the one or more processors 1003 to the system memory 1012. In the case of multiple processors 1003, the computing device 1001 may utilize parallel computing.

The bus 1013 may comprise one or more of several possible types of bus structures, such as a memory bus, memory controller, a peripheral bus, an accelerated graphics port, and a processor or local bus using any of a variety of bus architectures.

The computing device 1001 may operate on and/or comprise a variety of computer readable media (e.g., non-transitory). Computer readable media may be any available media that is accessible by the computing device 1001 and comprises, non-transitory, volatile and/or non-volatile media, removable and non-removable media. The system memory 1012 has computer readable media in the form of volatile memory, such as random access memory (RAM), and/or non-volatile memory, such as read only memory (ROM). The system memory 1012 may store data such as drilling data 1007 (i.e., data from signals received by the wireless sub) and/or program modules such as operating system 1005 and data logging software 1006 that are accessible to and/or are operated on by the one or more processors 1003.

The computing device 1001 may also comprise other removable/non-removable, volatile/non-volatile computer storage media. The mass storage device 1004 may provide non-volatile storage of computer code, computer readable instructions, data structures, program modules, and other data for the computing device 1001. The mass storage device 1004 may be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Any number of program modules may be stored on the mass storage device 1004. An operating system 1005 and data logging software 1006 may be stored on the mass storage device 1004. One or more of the operating system 1005 and data logging software 1006 (or some combination thereof) may comprise program modules and the data logging software 1006. Drilling data 1007 may also be stored on the mass storage device 1004. Drilling data 1007 may be stored in any of one or more databases known in the art. The databases may be centralized or distributed across multiple locations within the network 1015.

A user may enter commands and information into the computing device 1001 using an input device (not shown). Such input devices comprise, but are not limited to, a keyboard, pointing device (e.g., a computer mouse, remote control), a microphone, a joystick, a scanner, tactile input devices such as gloves, and other body coverings, motion sensor, and the like. These and other input devices may be connected to the one or more processors 1003 using a human machine interface 1002 that is coupled to the bus 1013, but may be connected by other interface and bus structures, such as a parallel port, game port, an IEEE 1394 Port (also known as a Firewire port), a serial port, network adapter 1008, and/or a universal serial bus (USB).

A display device 1011 may also be connected to the bus 1013 using an interface, such as a display adapter 1009. It is contemplated that the computing device 1001 may have more than one display adapter 1009 and the computing device 1001 may have more than one display device 1011. A display device 1011 may be a monitor, an LCD (Liquid Crystal Display), light emitting diode (LED) display, television, smart lens, smart glass, and/or a projector. In addition to the display device 1011, other output peripheral devices may comprise components such as speakers (not shown) and a printer (not shown) which may be connected to the computing device 1001 using Input/Output Interface 1010. Any step and/or result of the methods may be output (or caused to be output) in any form to an output device. Such output may be any form of visual representation, including, but not limited to, textual, graphical, animation, audio, tactile, and the like. The display 1011 and computing device 1001 may be part of one device, or separate devices.

The computing device 1001 may operate in a networked environment using logical connections to one or more remote computing devices 1014*a,b,c*. A remote computing device 1014*a,b,c* may be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. Logical connections between the computing device 1001 and a remote computing device 1014*a,b,c* may be made using a network 1015, such as a local area network (LAN) and/or a general wide area network (WAN). Such network connections may be through a network adapter 1008. A network adapter 1008 may be implemented in both wired and wireless environments. Such networking environments are conventional and commonplace in dwellings, offices, enterprise-wide computer networks, intranets, and the Internet. It is contemplated that the remote computing devices 1014*a,b,c* can optionally have some or all of the components disclosed as being part of computing device 1001. In some optional aspects, the remote computing devices 1014*a,b,c* can be in direct communication with each other and the computing device 1001 (e.g., optionally, via a dongle 460 as in FIG. 15C).

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drilling system, comprising: a drill string comprising: at least one drill rod, the at least one drill rod comprising a proximal drill rod; and at least one adapter operatively secured to the at least one drill rod, each adapter of the at least one adapter comprising processing circuitry, wherein the at least one adapter comprises a wireless sub that is operatively secured to the at least one drill rod proximally of the proximal drill rod, wherein the processing circuitry of the wireless sub is configured to detect mechanical impulses during a drilling operation within a borehole and to wirelessly transmit signals indicative of the mechanical impulses to a remote computing device.

Aspect 2: The drill string of aspect 1, wherein the processing circuitry of the wireless sub comprises at least one accelerometer.

Aspect 3: The drilling system of any one of the preceding aspects, wherein the processing circuitry of the wireless sub is configured to receive control signals from a remote device outside the borehole.

Aspect 4: The drilling system of any one of the preceding aspects, wherein each adapter of the drill string comprises a power source positioned in electrical communication with the processing circuitry of the adapter.

Aspect 5: The drilling system of aspect 4, wherein the power source of the wireless sub comprises a battery.

Aspect 6: The drilling system of any one of the preceding aspects, wherein the processing circuitry of the wireless sub is configured to determine the occurrence of at least one drilling condition selected from the group consisting of: an inner tube landing position; an inner tube latch mechanism position; an inner tube fluid control valve position; drilling fluid flow; drilling pressure; a drill string load impulse; a fully worn drill bit; excessive down-hole vibration; a blocked sample within an inner tube; a full inner tube; a sticking inner tube bearing; a failing inner tube bearing; low bearing grease pressure; and high bearing grease pressure.

Aspect 7: The drilling system of any one of the preceding aspects, wherein the processing circuitry of wireless sub comprises at least one fluid pressure sensor that is configured to detect at least one drilling condition.

Aspect 8: The drilling system of any one of the preceding aspects, wherein the wireless sub cooperates with the at least one drill rod to define an interior of the drill string.

Aspect 9: The drilling system of any one of the preceding aspects, further comprising: a drill bit; and an outer tube assembly having a distal end that is operatively coupled to the drill bit, wherein the tube assembly comprises at least one outer tube.

Aspect 10: The drilling system of aspect 9, further comprising: an inner tube assembly configured for positioning within the interior of the drill string, the inner tube assembly having: a core barrel head assembly defining an interior cavity; and processing circuitry positioned within the interior cavity of the core barrel head assembly, wherein the processing circuitry of the inner tube assembly is configured to detect mechanical impulses during drilling operations within a borehole and to wirelessly transmit signals indicative of the mechanical impulses to the processing circuitry of the wireless sub.

Aspect 11: The drilling system of aspect 10, wherein the processing circuitry of the inner tube assembly of the drill string comprises an accelerometer.

Aspect 12: The drilling system of any one of aspects 10-11, wherein the processing circuitry of the inner tube assembly comprises an electro-mechanical impulse generator configured to send mechanical impulse signals to the processing circuitry of the wireless sub.

Aspect 13: The drilling system of any one of aspects 10-12, wherein the processing circuitry of the wireless sub comprises an electro-mechanical impulse generator configured to send mechanical impulse signals to the processing circuitry of the inner tube assembly.

Aspect 14: The drilling system of any one of aspects 10-13, wherein the inner tube assembly comprises a power source positioned in electrical communication with the processing circuitry of the inner tube assembly.

Aspect 15: The drilling system of aspect 14, wherein the power source of the inner tube assembly comprises a battery.

Aspect 16: The drilling system of aspect 15, wherein the inner tube assembly comprises an electric generator that is electrically coupled to the battery.

Aspect 17: The drilling system of any one of aspects 10-17, wherein the processing circuitry of the wireless sub is configured to determine the times at which mechanical impulse data is detected by the processing circuitry of the inner tube assembly.

Aspect 18: The drilling system of any one of the preceding aspects, further comprising the remote computing device.

Aspect 19: The drilling system of aspect 18, further comprising a downhole sub that comprises processing circuitry that is configured to detect mechanical impulses of the drill string, wherein the downhole sub is in wireless communication with at least one of the wireless sub and the remote computing device.

Aspect 20: The drilling system of any one of aspects 10-19, wherein the processing circuitry of at least one adapter of the drill string comprises an electro-mechanical impulse generator configured to send mechanical impulse signals to the processing circuitry of the inner tube assembly.

Aspect 21: The drilling system of any one of the preceding aspects, wherein each adapter of the at least one adapter of the drill string comprises an electric generator that is electrically coupled to the battery.

Aspect 22: The drilling system of any one of the preceding aspects, wherein the processing circuitry of the wireless sub is configured to determine the times at which mechanical impulse data is detected by the processing circuitry of the inner tube assembly.

Aspect 23: The drilling system of any one of aspects 10-23, further comprising: a drill bit; and an outer tube assembly having a distal end that is operatively coupled to the drill bit, wherein the tube assembly comprises at least one outer tube.

Aspect 24: The drilling system of aspect 16, wherein the inner tube assembly comprises at least one inner tube positioned between the core barrel head assembly and the drill bit relative to the longitudinal axis of the drill string.

Aspect 25: The drilling system of any one of the preceding aspects, wherein the processing circuitry of the wireless sub comprises an ultrasonic transmitter that is configured to transmit ultrasonic signals corresponding to the detected mechanical impulses.

Aspect 26: The drilling system of any one of the preceding aspects, wherein the wireless sub defines an interior, wherein the wireless sub comprises: a foam body disposed within the interior and configured to displace air within the interior of the at least one adapter; and a desiccant.

Aspect 27: The drilling system of any one of the preceding aspects, further comprising the remote computing device, wherein at least one of the remote computing device and the processing circuitry of the wireless sub comprises a database comprising at least one condition that is associated with at least one mechanical impulse signature, wherein the at least one of the remote computing device and the processing circuitry of the wireless sub is configured to compare the mechanical impulses to the at least one mechanical impulse signature to determine an occurrence of the at least one condition.

Aspect 28: The drilling system of any one of the preceding aspects, wherein the wireless sub is not a floating sub.

Aspect 29: The drilling system of any one of the preceding aspects, wherein the wireless sub comprises at least two battery modules that are connected in parallel.

Aspect 30: The drilling system of any one of the preceding aspects, wherein the system further comprises a downhole sub that comprises processing circuitry that is configured to detect mechanical impulses of the drill string, wherein the downhole sub is in wireless communication with at least one of the wireless sub or the remote computing device.

Aspect 31: The system as in any of any one of the preceding aspects, wherein the wireless sub is configured to collect information corresponding to drilling productivity, wherein the wireless sub is configured to wirelessly communicate the information corresponding to drilling productivity to the remote computing device.

Aspect 32: The system of aspect 31, wherein the information corresponding to drilling productivity comprises an amount of time that the system is drilling into a formation.

Aspect 33: A drilling method, comprising: conducting a drilling operation within a borehole using the drilling system as in any one of aspects 1-32; detecting mechanical impulses using the at least one adapter of the drill string; and using the processing circuitry of the drill string to wirelessly transmit signals indicative of the mechanical impulses to a remote device outside the borehole.

Aspect 34: The method of aspect 33, further comprising: detecting mechanical impulses using the processing circuitry of the inner tube assembly; using the processing circuitry of the inner tube assembly to wirelessly transmit signals indicative of the mechanical impulses detected by the inner tube assembly to the processing circuitry of the drill string; and using the processing circuitry of the drill string to receive the signals transmitted by the processing circuitry of the inner tube assembly.

Aspect 36: A method of aspect 33, further comprising maintaining the wireless sub outside of a borehole while drilling with the drill string.

Aspect 37: An apparatus comprising: an adapter that is configured to be operatively secured to a proximal drill rod of a drill string, wherein the adapter is configured to cooperate with the drill rod to define an interior of the drill string, and wherein the adapter comprises processing circuitry that is configured to detect mechanical impulses during a drilling operation within a borehole and to wirelessly transmit signals indicative of the mechanical impulses to a remote computing device.

Although the foregoing invention has been described in some detail by way of illustration and example for purposes of clarity of understanding, certain changes and modifications may be practiced within the scope of the appended claims.

What is claimed is:

1. A drilling system, comprising:

a drill string comprising:

at least one drill rod, the at least one drill rod comprising a proximal drill rod; and at least one adapter operatively secured to the at least one drill rod, wherein the at least one adapter comprises a wireless sub that is operatively secured to the at least one drill rod proximally of the proximal drill rod, wherein the wireless sub defines an interior and comprises processing circuitry;

a downhole sub that comprises processing circuitry that is configured to detect mechanical impulses of the drill string, wherein the downhole sub is in wireless communication with the wireless sub, and wherein the downhole sub comprises a sensor that is configured to provide an output indicative of passage of an inner tube assembly through the downhole sub or positioning of a seated inner tube assembly at a distal end of the drill string; and a remote computing device, wherein the processing circuitry of the wireless sub is configured to wirelessly transmit signals indicative of the mechanical impulses or the output from the sensor of the downhole sub to the remote computing device.

2. The drill string of claim 1, wherein the processing circuitry of the wireless sub comprises at least one accelerometer.

3. The drilling system of claim 1, wherein the processing circuitry of the wireless sub is configured to receive control signals from the remote computing device.

4. The drilling system of claim 1, wherein the wireless sub comprises a power source positioned in electrical communication with the processing circuitry of the wireless sub.

5. The drilling system of claim 4, wherein the power source of the wireless sub comprises a battery.

6. The drilling system of claim 1, wherein the processing circuitry of the wireless sub is configured to determine the occurrence of at least one drilling condition selected from the group consisting of: an inner tube landing position; an inner tube latch mechanism position; an inner tube fluid control valve position; drilling fluid flow; drilling pressure; a drill string load impulse; a fully worn drill bit; excessive down-hole vibration; a blocked sample within an inner tube; a full inner tube; a sticking inner tube bearing; a failing inner tube bearing; low bearing grease pressure; and high bearing grease pressure.

7. The drilling system of claim 1, wherein the processing circuitry of the wireless sub comprises at least one fluid pressure sensor that is configured to detect at least one drilling condition.

8. The drilling system of claim 1, wherein the wireless sub cooperates with the at least one drill rod to define an interior of the drill string.

9. The drilling system of claim 1, further comprising:

a drill bit; and an outer tube assembly having a distal end that is operatively coupled to the drill bit, wherein the outer tube assembly comprises at least one outer tube.

10. The drilling system of claim 9, further comprising:

the inner tube assembly, wherein the inner tube assembly is configured for positioning within the interior of the drill string, the inner tube assembly having:

a core barrel head assembly defining an interior cavity; and processing circuitry associated with the core barrel head assembly, wherein the processing circuitry of the inner tube assembly is configured to detect mechanical impulses during drilling operations within a borehole and to wirelessly transmit signals indicative of the mechanical impulses to the processing circuitry of the wireless sub.

11. The drilling system of claim 10, wherein the processing circuitry of the inner tube assembly of the drill string comprises an accelerometer.

12. The drilling system of claim 11, wherein the processing circuitry of the inner tube assembly comprises an electro-mechanical impulse generator configured to send mechanical impulse signals to the processing circuitry of the wireless sub.

13. The drilling system of claim 10, wherein the processing circuitry of the wireless sub comprises an electro-mechanical impulse generator configured to send mechanical impulse signals to the processing circuitry of the inner tube assembly.

14. The drilling system of claim 10, wherein the inner tube assembly comprises a power source positioned in electrical communication with the processing circuitry of the inner tube assembly.

15. The drilling system of claim 14, wherein the power source of the inner tube assembly comprises a battery.

16. The drilling system of claim 15, wherein the inner tube assembly comprises an electric generator that is electrically coupled to the battery.

17. The drilling system of claim 10, wherein the processing circuitry of the wireless sub is configured to determine the times at which mechanical impulse data is detected by the processing circuitry of the inner tube assembly.

18. The drilling system of claim 1, wherein the processing circuitry of the wireless sub comprises an ultrasonic transmitter that is configured to transmit ultrasonic signals corresponding to the detected mechanical impulses.

19. The drilling system of claim 1, wherein the sensor of the downhole sub comprises a load sensor, an inductive proximity sensor, or a resistive proximity sensor.

20. A drilling method, comprising:

conducting a drilling operation within a borehole using a drilling system, wherein the drilling system comprises:

a drill string comprising:

at least one drill rod, the at least one drill rod comprising a proximal drill rod; and at least one adapter operatively secured to the at least one drill rod, wherein the at least one adapter comprises a wireless sub that is operatively secured to the at least one drill rod proximally of the proximal drill rod, wherein the wireless sub defines an interior and comprises processing circuitry;

a downhole sub that comprises processing circuitry that is configured to detect mechanical impulses of the drill string, wherein the downhole sub is in wireless communication with the wireless sub, and wherein the downhole sub comprises a sensor that is configured to provide an output indicative of passage of an inner tube assembly through the downhole sub or positioning of a seated inner tube assembly at a distal end of the drill string; and a remote computing device outside the borehole, detecting, by the downhole sub, mechanical impulses, passage of an inner tube assembly through the downhole sub, or positioning of a seated inner tube assembly at the distal end of the drill string;

wirelessly transmitting, by the processing circuitry of the downhole sub, signals to the wireless sub that are indicative of the mechanical impulses or the output from the sensor of the downhole sub; and wirelessly transmitting, by the processing circuitry of the wireless sub, signals to the remote computing device that are indicative of the mechanical impulses or the output from the sensor of the downhole sub.

21. The drilling method of claim 20, wherein the wireless sub remains outside the borehole during the drilling operation.

* * * * *